US005471286A

United States Patent [19]

Tanaka

[11] Patent Number: 5,471,286

[45] Date of Patent: Nov. 28, 1995

[54] IMAGE FORMING APPARATUS WITH RETRACTABLE DEVELOPING UNIT INCLUDING PLURAL SELF-ALIGNING DEVELOPER BEARING ROLLERS

[75] Inventor: Makoto Tanaka, Tokyo, Japan

[73] Assignee: Canon Kabushiki Kaisha, Tokyo, Japan

[21] Appl. No.: 123,220

[22] Filed: Sep. 20, 1993

[30] Foreign Application Priority Data

Oct. 2, 1992 [JP] Japan ..... 4-287109
Jul. 20, 1993 [JP] Japan ..... 5-179242

[51] Int. Cl.[6] ..... G03G 15/06

[52] U.S. Cl. ..... 355/245; 355/259; 355/326 R

[58] Field of Search ..... 355/245, 260, 355/259, 326 R, 327; 118/656

[56] References Cited

U.S. PATENT DOCUMENTS 4,882,605 11/1989 Sakamoto ..... 355/245 X
5,089,849 2/1992 Hiraoka ..... 355/245 X
5,300,987 4/1994 Aoyama et al. ..... 355/245

FOREIGN PATENT DOCUMENTS 56-47070 4/1981 Japan ..... 355/259

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

A developing unit includes first and second developing rollers for supplying a photosensitive member (drum) with a developer having the same color. A plurality of spacers are provided on the developing unit, so that when the developing unit is advanced such that it is pressed against the photosensitive drum, these spacers contact the photosensitive drum and maintain predetermined spacing or gaps therebetween between the first and second developing rollers and the photosensitive drum. For example, in one embodiment, a spacer is provided at each longitudinal end of each developing roller. In another embodiment, a spacer is provided at a single end of each developing roller as well as at an intermediate position between the developing rollers.

19 Claims, 19 Drawing Sheets

IMAGE FORMING APPARATUS WITH RETRACTABLE DEVELOPING UNIT INCLUDING PLURAL SELF-ALIGNING DEVELOPER BEARING ROLLERS

BACKGROUND OF THE INVENTION

1. Field of the Invention

The present invention relates to an image forming apparatus which forms a visible image by developing an elestrostatic latent image.

2. Description of the Related Art

In a conventional image forming apparatus, first and second developer bearing members are disposed along a moving path of an image bearing member, and each of the developer bearing members supplies the image bearing member with a developer having a same color.

FIG. 1 illustrates a principal portion of the above-described image forming apparatus. A cylindrical electrophotographic photosensitive member, or photosensitive drum 1, serves as the image bearing member, and rotates in a clockwise direction during an image forming operation. An electrostatic latent image formed on photosensitive drum 1 is developed by developing unit 10. Developing unit 10 includes receptacle or container 11 having a chamber 12 for containing a developer.

Cylindrical developer bearing members, i.e., developing rollers 2 and 5, are rotatably supported in receptacle 11. First and second developing rollers 2 and 5 rotate in a counterclockwise direction during an image forming operation, to carry the developer contained within developer accommodating chamber 12 and to supply the developer to photosensitive drum 1.

As shown in FIG. 1, first and second developing rollers 2 and 5 are disposed in parallel with an interval spacing in the direction of rotation of drum 1. Each of first and second developing rollers 2 and 5 carries the developer having the same color, i.e., the same component, and supplies the developer to photosensitive drum 1. Accordingly, the electrostatic latent image formed on photosensitive drum 1 is first subjected to preliminary development by first developing roller 2, and then subjected to finishing development by second developing roller 8.

As shown in FIG. 2, spacer rollers 3 and 4 are rotatably supported on shafts **2*a* and 2*b* present at two end-portions of first developing roller 2 in the longitudinal direction, respectively, and spacer rollers 6 and 7 are rotatably supported on shafts 5*a* and 5*b* present at two end-portions of second developing roller 5 in the longitudinal direction, respectively. That is, spacer rollers 3 and 4, and spacer rollers 6 and 7 are provided coaxially with respect to first and second developing rollers 2 and 5**, respectively.

As shown in FIG. 1, the above-described spacer rollers 3 and 4, and spacer rollers 6 and 7 are in pressure contact with two end-portions of photosensitive drum 1 in the longitudinal direction. Thus, the gap between photosensitive drum 1 and first developing roller 2, and the gap between photosensitive drum 1 and second developing roller 5 are maintained constant.

Developing unit 10 is supported on guide member 13, and can be longitudinally advanced and retracted with respect to photosensitive drum 1. More specifically, foot member 17 protruding from receptacle 11 of developing unit 10 is slidably supported on guide member 13.

As will be described later, developing unit 10 can be detached from the main body of the image forming apparatus by drawing developing unit 10 along guide 13 forwardly with respect to the plane of FIG. 1 in a state in which developing unit 10 is retracted from photosensitive drum 1. On the other hand, developing unit 10 can be mounted on the main body of the image forming apparatus by inserting developing unit 10 along guide 13 backwardly with respect to the plane of FIG. 1 while mounting foot member 17 of developing unit 10 on guide 13.

Guide member 13 is supported by guide member 16 fixed to the main body of the image forming apparatus so that it can be advanced and retracted with respect to photosensitive drum 1. Two pressure-receiving members **13*a* and 13*b* facing each other are provided on guide member 13. The two pressure-receiving members 13*a* and 13*b* engage eccentric cam 15 fixed to shaft 14**.

That is, when shaft 14 is rotated by a motor or manually in a counterclockwise direction, pressure receiving member **13*a* of guide member 13 is pushed by cam 15, whereby developing unit 10 moves together with guide member 13 in the direction of arrow A shown in FIG. 1. In this manner, spacer rollers 3, 4, 6 and 7 of developing unit 10 are disposed in pressure contact with photosensitive drum 1**.

When developing unit 10 or photosensitive drum 1 is to be detached from the image forming apparatus, shaft 14 is rotated by a motor or manually in a clockwise direction, whereby pressure-receiving member **13*b* of guide member 13 is pushed by cam 15, and developing unit 10 moves together with guide member 13 in the direction of arrow B shown in FIG. 1. In this manner, developing unit 10 is removed from pressure contact with photosensitive drum 1. That is, spacer rollers 3, 4, 6 and 7 are removed from pressure contact with photosensitive drum 1**.

In FIG. 2, gear 8 is fixed to shaft **2*b* which is fixed to first developing roller 2, and gear 9 is fixed to shaft 5*b* which is fixed to second developing roller 5. Idle gear 10 meshes gears 8 and 9. When developing unit 10 is in pressure contact with photosensitive drum 1 as shown in FIG. 1, gear 9 meshes with driving gear 18 provided in the main body of the image forming apparatus (not shown). Gear 18 is rotatably driven by a motor (not shown), whereby developing rollers 2 and 5** are rotatably driven in the above-described manner.

The mutual positional relationship among the four spacers 3, 4, 6 and 7 is fixed in developing unit 10 shown in FIGS. 1 and 2.

Accordingly, for example, if the mutual positional relationship among the four spacers 3, 4, 6 and 7 deviates from a predetermined relationship due to error in production, or if tolerances in guide member 13 or 16 are inferior, a case may arise in which only three of the four spacers are disposed in pressure contact with photosensitive drum 1.

In such a case, the gap between the first developing roller 2 and the photosensitive drum 1, or the gap between the second developing roller 5 and the photosensitive drum 1 is not constant with respect to the longitudinal direction of the corresponding developing roller, thereby causing a variation in the picture quality of the formed developed image in the direction of the width.

Such a problem can be overcome in an apparatus shown in FIG. 3. In the apparatus of FIG. 3, first developing unit 101 is configured by providing first developing roller 2 in receptacle 11, and second developing unit 102 is configured by providing second developing roller 5 in receptacle 11'. Spacer rollers 3 and 4 are provided at two end-portions of roller 2, and spacer rollers 6 and 7 are provided at two end-portions of roller 5.

First developing unit 101 and second developing unit 102 are advanced and retracted, thereby to pressure contact photosensitive drum 1 by cams 15 and 15', respectively. Thus, developing units 101 and 102 can be pressed against photosensitive drum 1 so that developing rollers 2 and 5 are parallel to photosensitive drum 1.

In this apparatus, however, two pressing means (15 and 14, and 15' and 14') are required, thereby requiring a complicated and large apparatus. Furthermore, it is necessary to perform operations for individually mounting or detaching the two developing units 101 and 102 with respect to the image forming apparatus, thereby causing an increase in the burden of the operator.

In FIG. 3, components represented by numerals having apostrophes have the same functions as components represented by the same numerals not having apostrophes.

SUMMARY OF THE INVENTION

It is an object of the present invention to provide an image forming apparatus in which first and second developer bearing members can face an image bearing member in an exact positional relationship.

It is another object of the present invention to provide an image forming apparatus having a simple configuration in which first and second developer bearing members can be disposed in parallel to an image bearing member.

In one aspect, the present invention relates to an image forming apparatus including an image bearing member, a developing unit for developing an electrostatic latent image formed on the image bearing member, supporting means for supporting the developing unit for movement relative to the image baring member between a contact position and a non-contact position, and pressing means for advancing and retracting the developing unit between the contact position and the non-contact position, and for pressing the developing unit against the image bearing member in the contact position. The developing unit includes first and second developer bearing members facing the image bearing member for carrying a developer and for supplying the developer to the image bearing member, and holding means for holding the first and second developer bearing members and for aligning the first and second developer bearing members in a moving direction of the image bearing member. First and second spacers are disposed at one end portion of the developing unit in a longitudinal direction of the developer bearing members with a predetermined interval spacing in a moving direction of the image bearing member, and a third spacer is disposed at the other end portion of the developing unit in the longitudinal direction of the developer bearing members. The first, second and third spacers are arranged for contacting the image bearing member in the contact position with a pressing force of the pressing means, thereby to form respective gaps between the first developer bearing member and the image bearing member, and between the second developer bearing member and the image bearing member.

In another aspect, the present invention relates to an image forming apparatus, including an image bearing member, and a developing unit for developing an electrostatic latent image formed on the image bearing member. The developing unit includes first and second developing unit components. The first developer unit component includes a first developer bearing member for carrying a developer and supplying the developer to the image bearing member, and first and second spacers provided at respective end portions of the first developing unit component in a longitudinal direction of the first developer bearing member and arranged for pressure contacting the image bearing member. The second developing unit component includes a second developer bearing member for carrying the developer and for supplying the developer to the image bearing member, and third and fourth spacers provided at respective end portions of the second developing unit component in the longitudinal direction of the second developer bearing member and arranged for pressure contacting the image bearing member. The first developing unit component is mechanically connected to the second developing unit component so that the first and second developing unit components can be relatively moved. Supporting means is provided for supporting the developing unit for movement relative to the image bearing member between a contact position and a non-contact position, and pressing means is provided for advancing and retracting the developing unit between the contact position and the non-contact position, and for applying a pressing force to the second developing unit component, thereby to press the developing unit against the image bearing member. In this manner, when the developing unit is advanced by the pressing means, the first and second spacers of the first developing unit component are first pressure contacted to the image bearing member, and the third and fourth spacers of the second developing unit component are then pressure contacted to the image bearing member.

In yet another aspect, the present invention relates to an image forming apparatus, including an image bearing member, and a developing unit for developing an electrostatic latent image formed on the image bearing member. The developing unit includes first and second developer bearing members for carrying a developer and for supplying the developer to the image bearing member, and a plurality of spacers for aligning the first and second developer bearing members relative to the image bearing member in a contact position, for providing a first gap between the first developer bearing member and the image bearing member in the contact position, and for providing a second gap between the second developer bearing member and the image bearing member in the contact position. Supporting means are provided for supporting the developing unit for movement relative to the image bearing member, and for moving the developing unit between a non-contact position and the contact position.

These and other objects, advantages and features of the present invention will become more apparent from the following description of the preferred embodiments taken in conjuction with the accompanying drawings.

DESCRIPTION OF THE PREFERRED EMBODIMENTS

Figure 1:
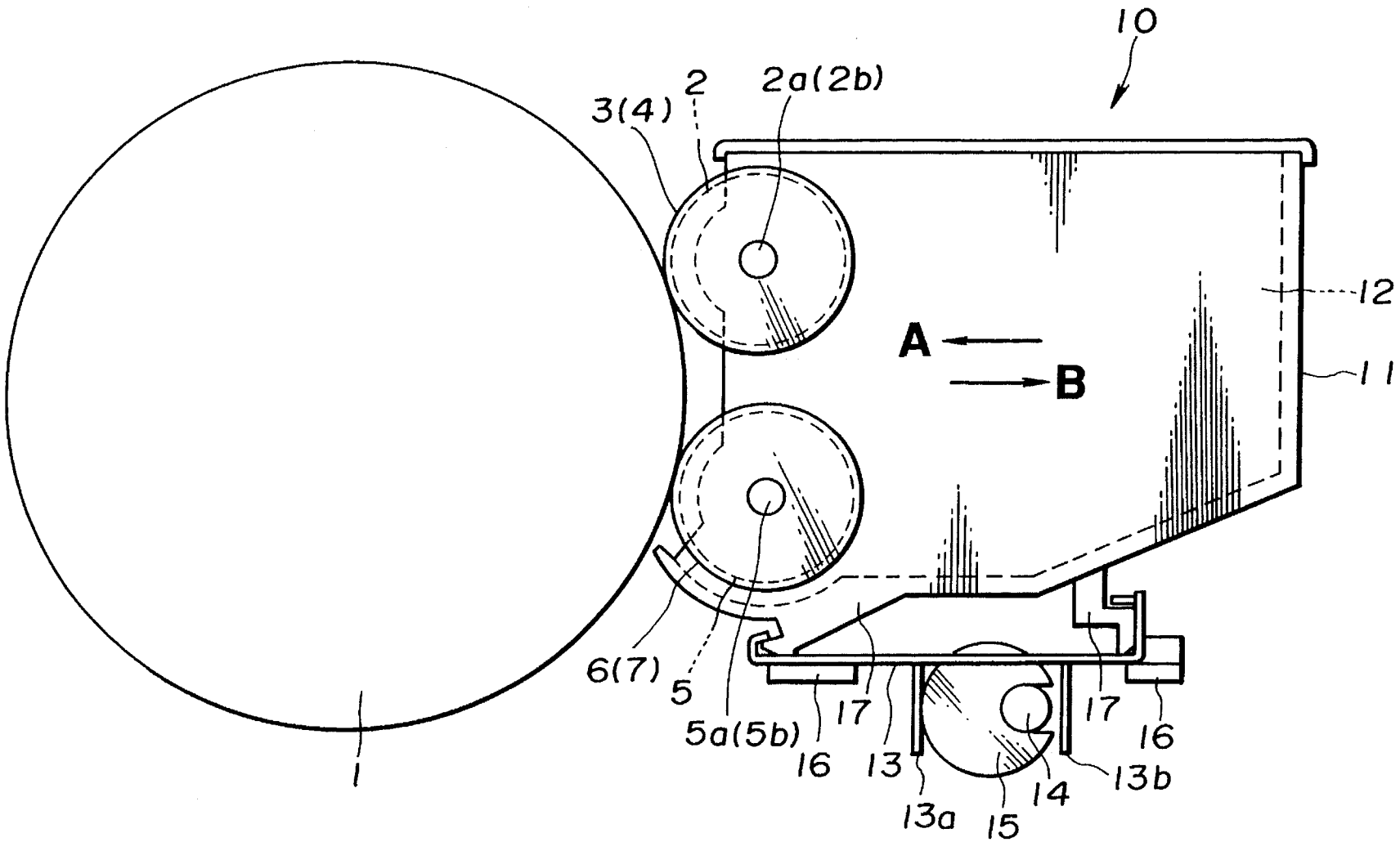
FIG.1 (PRIOR ART)
FIG. 1 is a diagram illustrating a principal portion of a conventional image forming apparatus.
Figure 2:
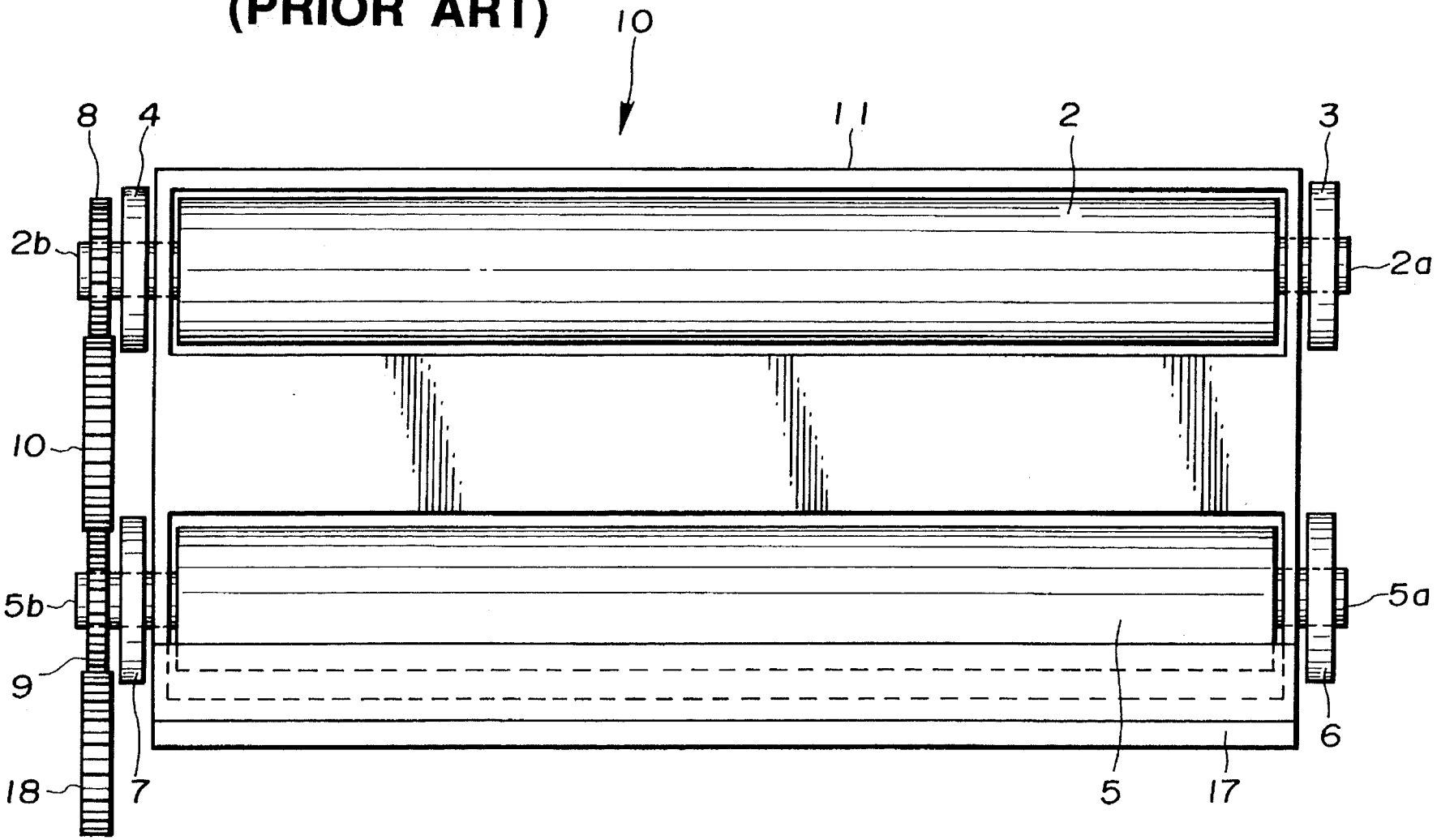
FIG.2 (PRIOR ART)
FIG. 2 is a front view of a developing unit of the apparatus shown in FIG. 1.
Figure 3:
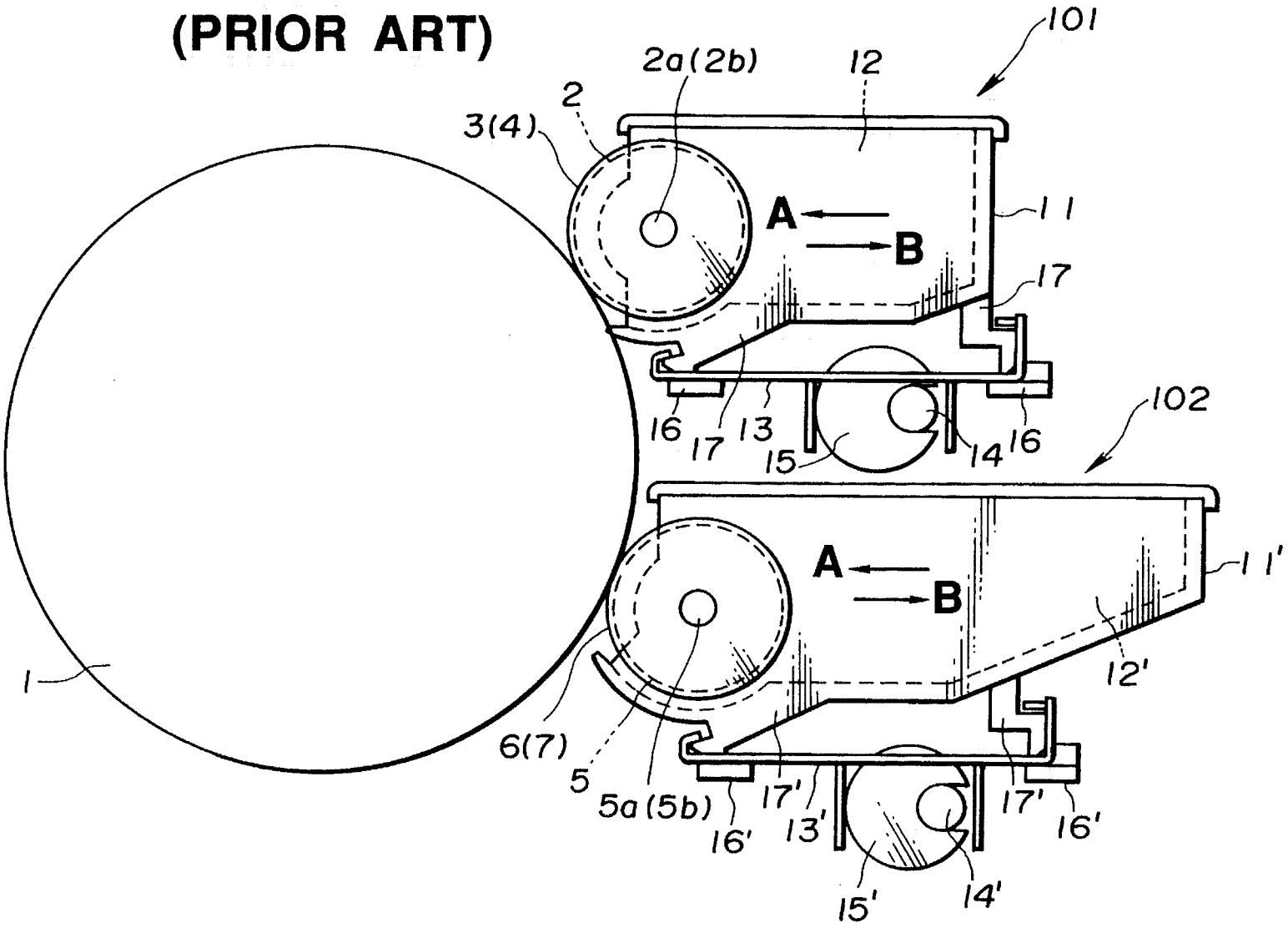
FIG.3 (PRIOR ART)
FIG. 3 is a diagram illustrating a principal portion of another conventional image forming apparatus.

In the following preferred embodiments of the present invention, components having the same functions as those shown in FIGS. 1 through 3 are indicated by the same reference numerals, and an explanation thereof will be omitted unless specifically needed.

Figure 4:
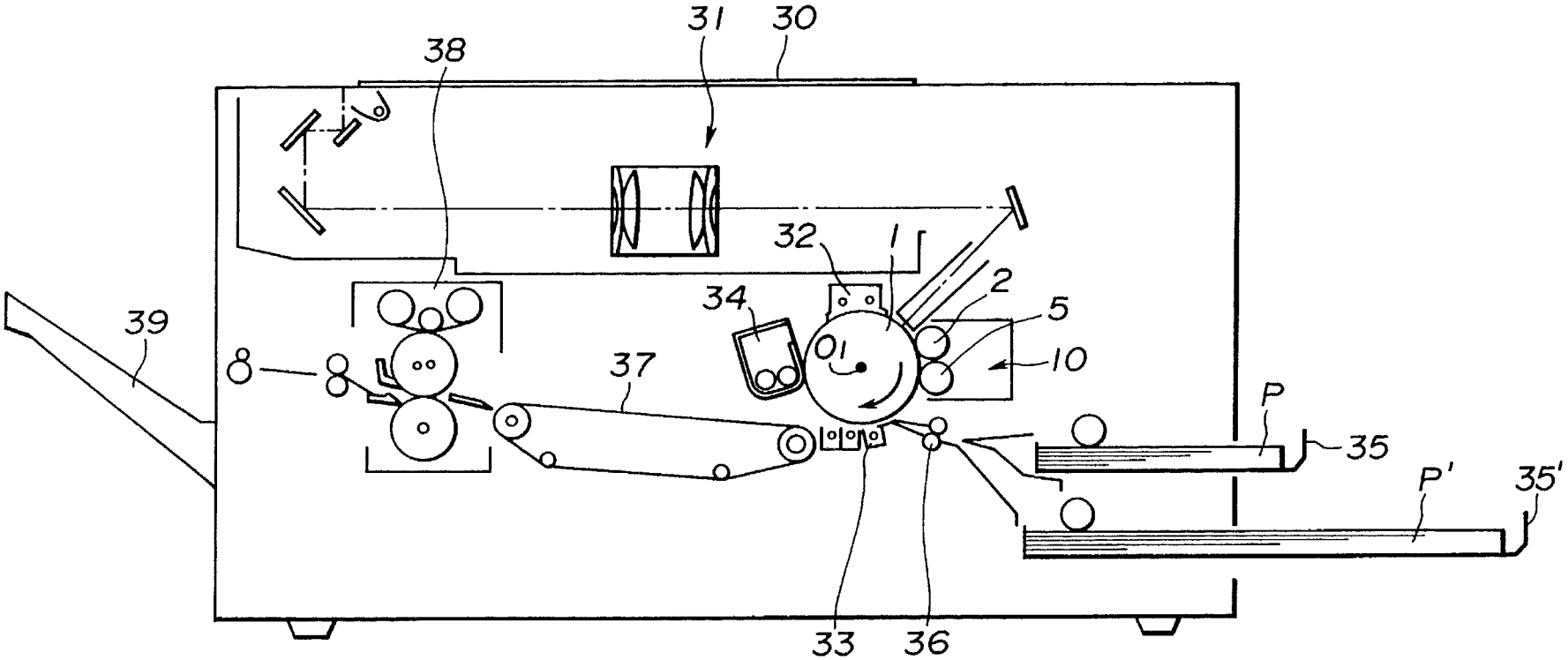
FIG. 4 is a diagram illustrating an electrophotographic apparatus to which the present invention can be applied.

FIG. 4 illustrates an electrophotographic apparatus to which the present invention can be applied.

In an image forming operation in which an electrostatic latent image is formed, the latent image is developed with toner, the developed toner image formed on cylindrical electrophotographic photosensitive drum 1 is transferred onto transfer paper, and the transferred toner image on the transfer paper is fixed. Photosensitive drum 1 rotates around its central axis $O_1$ in the direction of the arrow shown in FIG. 4. Photosensitive drum 1 rotating in the direction of the arrow is first uniformly charged by charger 32, and is exposed by an optical system 31 to an optical image of an original to be copied, the original being mounted on an original-mount 30, whereby an electrostatic latent image is formed on drum 1. This latent image is developed by developing unit 10, including two developing rollers 2 and 5. The developed toner image formed on drum 1 then is transferred by charger 33 onto a transfer paper P or P', which is fed from a paper cassette 35 or 35', respectively, by registration rollers 36. After being separated from drum 1, the transfer paper is fed by a belt 37 to a fixing unit 38, in which the toner image is fixed on the transfer paper. The transfer paper passing through fixing unit 38 is discharged onto tray 39. Toner particles remaining on the surface of drum 1 after the transfer operation are removed by cleaner 34.

In the same manner as in the above-described conventional apparatuses, cylindrical first developer bearing member, i.e., first developing roller 2, and cylindrical second developer bearing member, i.e., second developing roller 5, are disposed with an interval spacing in the circumferential direction of drum 1. First developing roller 2 is arranged parallel to second developing roller 5. In a state in which the developing unit is in pressure contact with photosensitive drum 1, first and second developing rollers 2 and 5 are parallel to photosensitive drum 1.

In a state in which spacers (to be described later) are disposed in pressure contact with drum 1, first and second developing rollers 2 and 5 face photosensitive drum 1 with a minute gap of about 50–100 μm.

The thickness of the layer of a one-component developer carried (the toner layer) to each developing region, where each of the first and second developing rollers 2 and 5 provides drum 1 with the developer, i.e., each position having the above-described minute gap, is thinner than the above-described minute gap. In other words, each of first and second developing rollers 2 and 5 performs non-contact development of the electrostatic latent image.

In order to improve the efficiency of development, a vibrating bias voltage obtained by superposing an AC voltage on a DC voltage is applied from a power supply (not shown) to each of developing rollers 2 and 5. A vibrating electric field is thereby formed in the developing region between developing roller 2 and drum 1, and the developing region between developing roller 5 and drum 1. Thus, toner particles leave developing rollers 2 and 5, and adhere to the electrostatic latent image.

The above-described first developing roller 2 is used for improving reproducibility of fine lines, and the second developing roller 5 is used for improving reproducibility of halftones, and density. For that purpose, different developing bias voltages are applied to first and second developing rollers 2 and 5. For example, the peak-to-peak value $V_{pp}$ and the frequency f of the first vibrating bias voltage applied to first developing roller 2 is greater than those of the second vibrating bias voltage applied to second developing roller 5. At that time, from the viewpoint of preventing fog in the obtained image, it is preferable to arrange the elements of the apparatus so that the DC voltage component $V_{DC}$ of the vibrating bias voltage (obtained by superposing an AC voltage on a DC voltage) of the second vibrating bias voltage is closer to the potential of a non-image portion (the light-portion potential) of the latent image than that of the first vibrating bias voltage. For example, when the dark-portion potential (image-portion potential) of the latent image is −450 V, and the light-portion potential of the latent image is −40 V, the first vibrating bias voltage may have values of $V_{pp}$=1400 V, f=1200 Hz, and $V_{DC}$=−300 V, and the second vibrating bias voltage may have values of $V_{pp}$=900 V, f=350 Hz, and $V_{DC}$=−200 V.

Alternatively, a DC bias voltage may be applied to developing rollers 2 and 5.

The developing region where a one-component developer (toner) is transferred from the developing roller to the photosensitive drum equals or is in the vicinity of the closest position between the developing roller and the photosensitive drum.

The one-component developer (toner) supplied from each of developing rollers 2 and 5 to photosensitive drum 1 has a monochromatic color, such as black.

Figure 5:
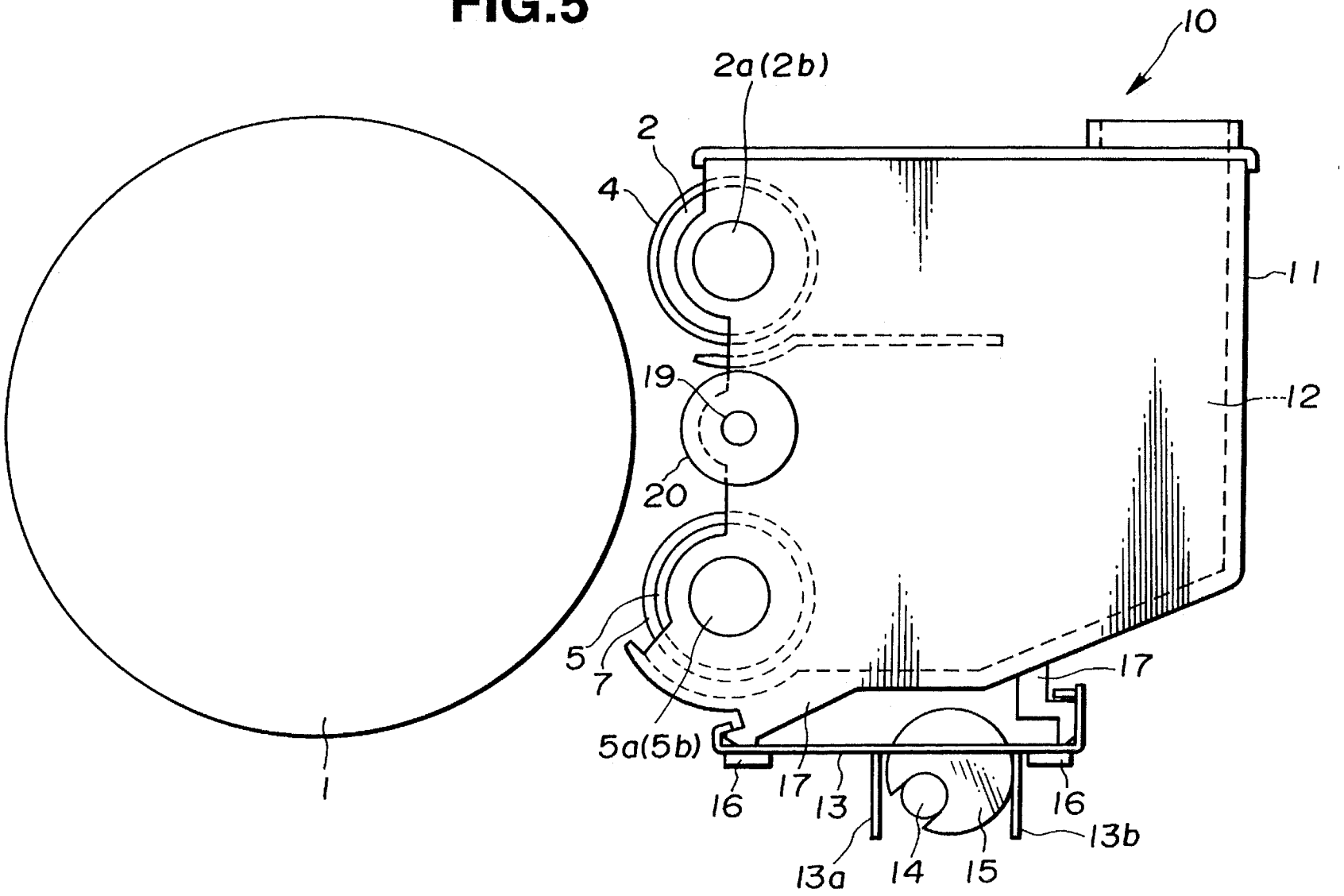
FIG. 5 is a side view illustrating a state of a principal portion of an apparatus according to an embodiment of the present invention in which a developing unit is retracted from a photosensitive drum.
Figure 6:
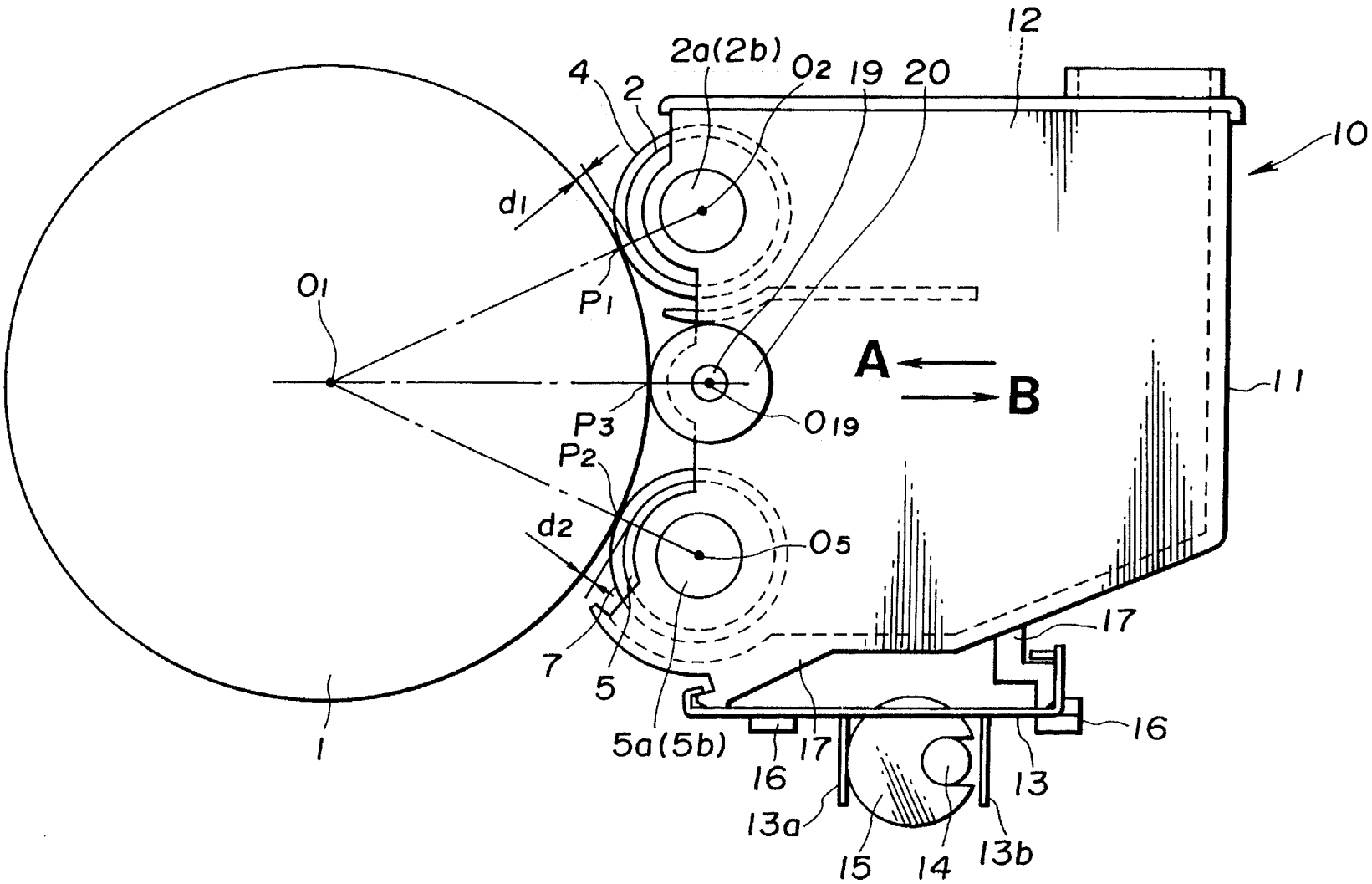
FIG. 6 is a diagram illustrating a state of the principal portion of the apparatus shown in FIG. 5 in which the developing unit is advanced so that it is in pressure contact with the photosensitive drum.
Figure 7:
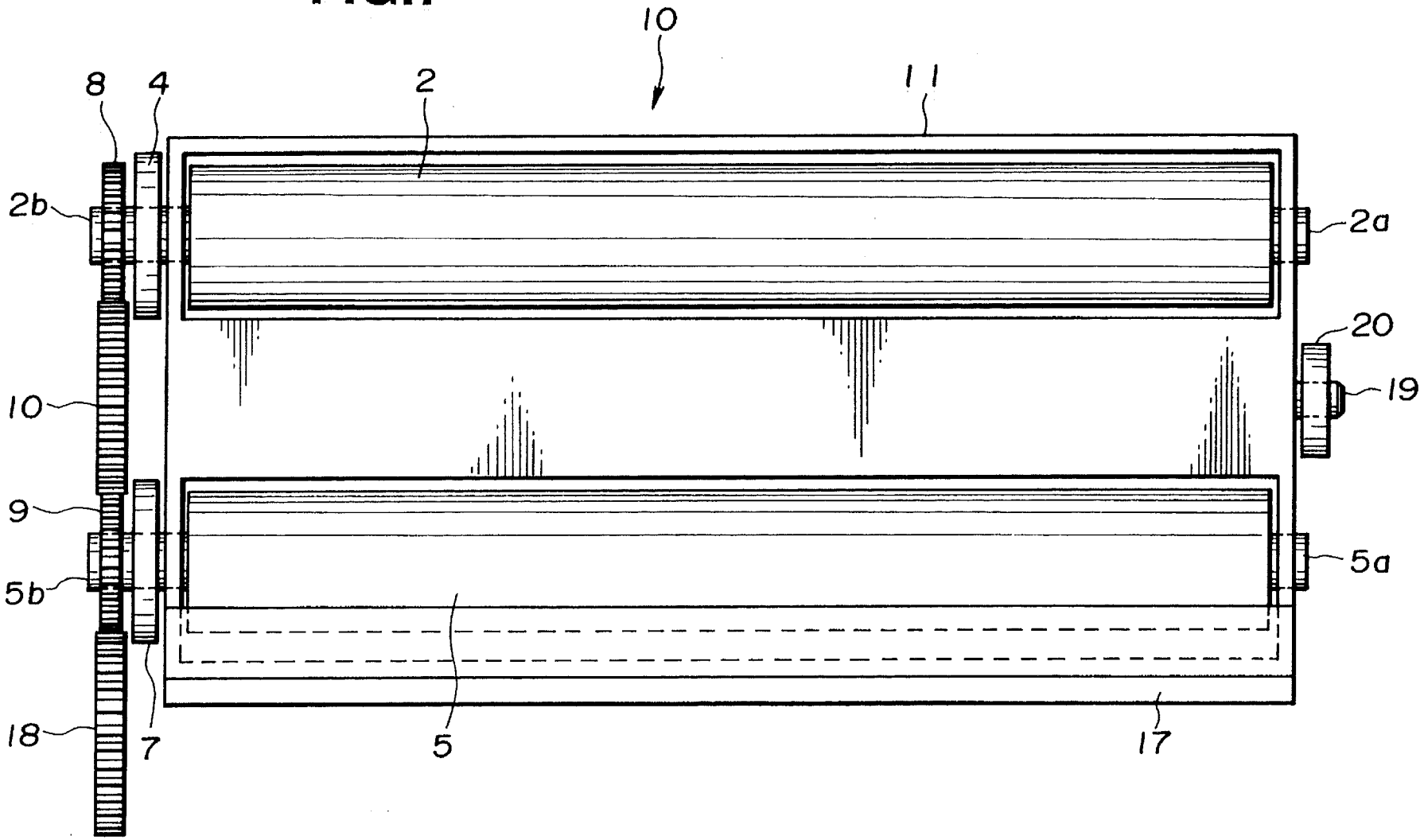
FIG. 7 is a front view of the developing unit shown in FIG. 5.

As shown in FIGS. 5 through 7, in an embodiment of the present invention, spacer roller 4 is rotatably supported on shaft **2*b* provided at one end-portion of first developing roller 2 in the longitudinal direction, and spacer roller 7 is rotatably supported on shaft 5*b* provided at one end-portion of second developing roller 5 in the longitudinal direction. That is, spacer rollers 4 and 7 are provided coaxially with respect to first and second developing rollers 2 and 5, respectively, at one end-portion of the respective developing rollers in the longitudinal direction, in the same manner as in the apparatus shown in FIGS. 1 and 2**.

On the other hand, in the present embodiment, as shown in FIGS. 5 through 7, only one spacer roller 20 is provided at another end-portion of developing unit 10 in the longitudinal direction of the developing rollers. This spacer roller 20 is rotatably supported on shaft 19 secured to receptacle 11 at a position between shaft **2*a* of first developing roller 2 and shaft 5*a* of second developing roller 5**.

Thus, three spacers in total are provided in the apparatus shown in FIGS. 5 through 7.

FIG. 5 illustrates developing unit 10 in a retracted or non-operating position, in which it does not contact photosensitive drum 1. FIG. 6 illustrates developing unit 10 in an advanced or operating position for development in which the above-described spacers 4, 5 and 20 of developing unit 10 are disposed in pressure contact with photosensitive drum 1.

In the state of FIG. 5, if shaft 14 is rotated in a counterclockwise direction by the driving force of a motor or by a manual operation of the operator, eccentric cam 15 contacts pressure-receiving member **13*a* of movable guide member 13 to move guide member 13 in the direction of arrow A shown in FIG. 6. Thus, developing unit 10 moves in the direction of arrow A as one body with guide member 13, and is advanced so that it is disposed in pressure contact with photosensitive drum 1, as shown in FIG. 6**.

As described above, the apparatus of the present invention utilizes only three spacer rollers. Hence, according to the principle of three-point suspension, all the spacer rollers 4, 7 and 20 can be securely disposed in pressure contact with photosensitive drum 1.

It is thereby possible to securely maintain the gap between first developing roller 2 and photosensitive drum 1, and the gap $d_2$ between second developing roller 5 and photosensitive drum 1, and to securely maintain the values of the gaps $d_1$ and $d_2$ uniform in the longitudinal direction of the developing rollers.

Point $P_1$ where spacer roller 4 is in pressure contact with photosensitive drum 1 is present on straight line $O_1O_2$ obtained by connecting the center of rotation $O_2$ of first developing roller 2 and the center of rotation $O_1$ of photosensitive drum 1. Point $P_2$ where spacer roller 7 is in pressure contact with photosensitive drum 1 is present on straight line $O_1O_5$ obtained by connecting the center of rotation $O_5$ of second developing roller 5 and the center of rotation $O_1$ of photosensitive drum 1. Point $P_3$ where spacer roller 20 is in pressure contact with photosensitive drum 1 is present on straight line $O_1O_{19}$ obtained by connecting the center of rotation $O_{19}$ of spacer roller 20 and the center of rotation $O_1$ of photosensitive drum 1.

From the viewpoint of improving the stability of the operation of developing unit 10, it is desirable that straight line $O_1P_3$ substantially coincides with a line that bisects the angle made by straight line $P_1O_1$ and straight line $P_2O_1$.

In addition, from the viewpoint of pressing developing unit 10 against photosensitive drum 1 in a more stable state, it is desirable that the direction of pressing developing unit 10 against photosensitive drum 1. i.e., the direction of arrow A, is substantially parallel to straight line $O_1P_3$.

When developing unit 10 is moved to the operating position for development shown in FIG. 6, gear 9 provided on shaft **5*b* at one end-portion of developing roller 5 meshes with driving gear 18 provided in the main body of the image forming apparatus and thereby is rotatably driven by a motor (not shown), in the same manner as in the apparatus shown in FIGS. 1 and 2**.

Thus, second developing roller 4 is rotatably driven, and first developing roller 2 is rotatably driven via idle gear 10 and gear 8.

As shown in FIG. 7, the above-described gears 8 and 9 receiving the driving force are provided not at the side where the single spacer roller 20 is provided, but at the side where the two spacer rollers 4 and 7 are provided. It is thereby possible to improve the stability of the rotational driving of developing rollers 2 and 5.

In the present embodiment, as well as in embodiments to be described later, a driving gear 18 may mesh with either the gear 8 or the gear 10. A gear provided at an end-portion of photosensitive drum 1 coaxially with respect to photosensitive drum 1 may also be utilized as the driving gear 18. In this case, the idle gear 10 becomes unnecessary, since the driving gear can mesh with both gears 8 and 9.

In the state of FIG. 6, when shaft 14 is rotated in a clockwise direction by a motor or by a manual operation of the operator in the state of FIG. 6, eccentric cam 15 contacts pressure receiving member **13*b* of movable guide member 13, whereby guide member 13 moves in the direction of arrow B. Accordingly, developing unit 10 moves in the direction of arrow B, which is reverse to the direction of arrow A, as one body with guide member 13. That is, developing unit 10 is retracted away from photosensitive drum 1, and moves to the retracted or non-operating position shown in FIG. 5**.

As described above, in the position of FIG. 5, developing unit 10 may be mounted or detached relative to guide member 13, or photosensitive drum 1 may be mounted or detached relative to the main body of the apparatus.

At that time, spacer rollers 4, 7 and 20 are separated from photosensitive drum 1. Hence, photosensitive drum 1 is prevented from being damaged during such above-described maintenance operations.

Developing unit 10 may be retracted from photosensitive drum 1 and held at the non-operating position of FIG. 5 while an image forming operation is interrupted, as well as in a maintenance operation, such as mounting/detaching of developing unit 10 or photosensitive drum 1 relative to the main body of the image forming apparatus. In such a case, shaft 14 is driven by a motor, whose operation is controlled by control means, to move developing unit 10 to the operating position for development for each image forming operation. Such an operation is also performed in embodiments to be described later.

Figure 8:
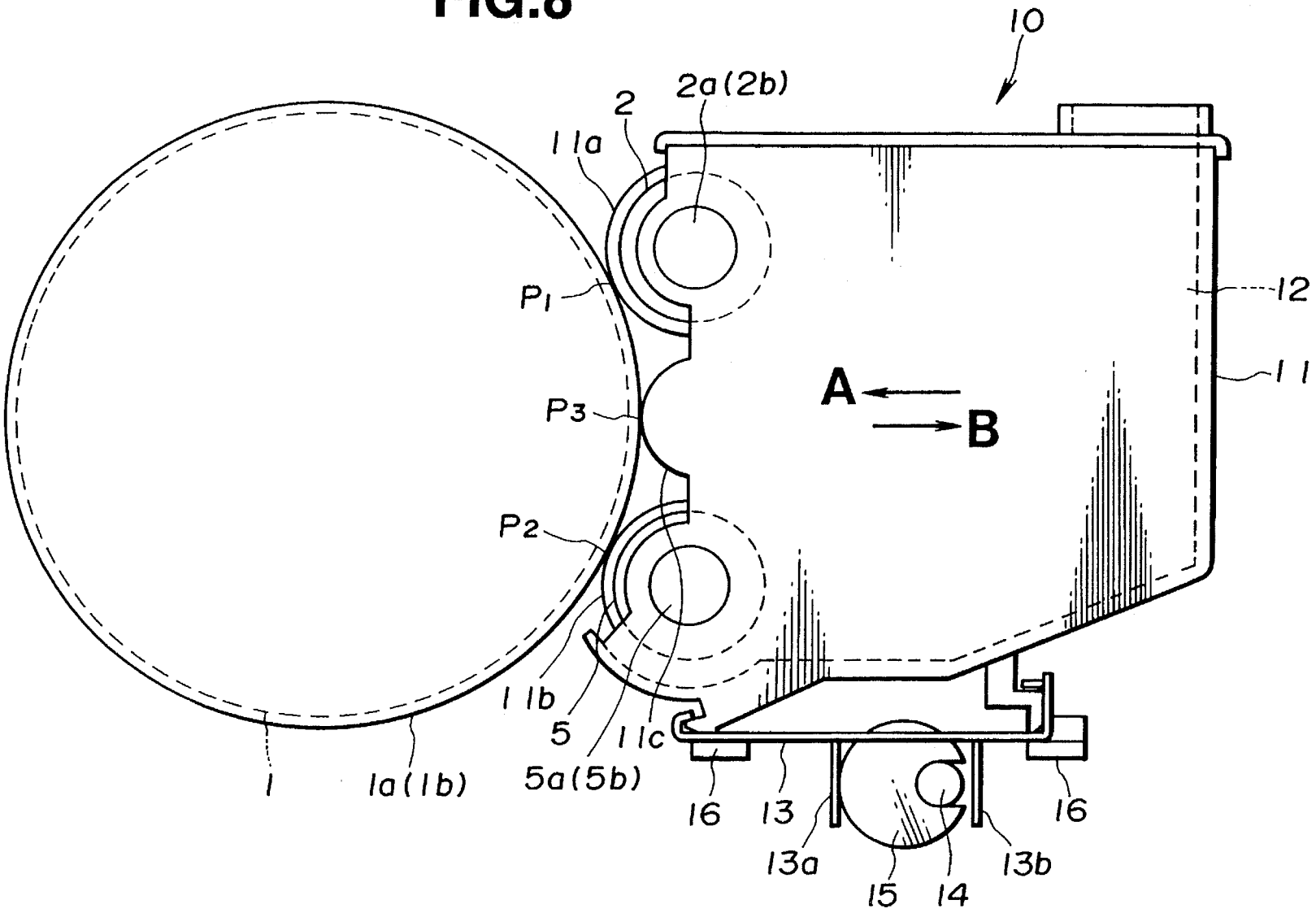
FIG. 8 is a side view illustrating a principal portion of an apparatus according to another embodiment of the present invention.

In another embodiment of the present invention illustrated in FIG. 8, projections 11*a*, 11*b* and 11*c* of receptacle 11 are utilized as three spacers. That is, two projections 11*a* and 11*b* are provided at receptacle 11 at one end-portion in the longitudinal direction of the developing rollers, and a single projection 11*c* is provided at receptacle 11 at another end-portion in the longitudinal direction of the developing rollers.

The above-described spacer projections 11*a* and 11*b* are disposed in pressure contact with disk 1*b*, which is coaxially fixed to photosensitive drum 1 at one end-portion thereof, and the spacer projection 11*c* is disposed in pressure contact with disk 1*a* which is coaxially fixed to photosensitive drum 1 at another end-portion thereof.

Figure 13:
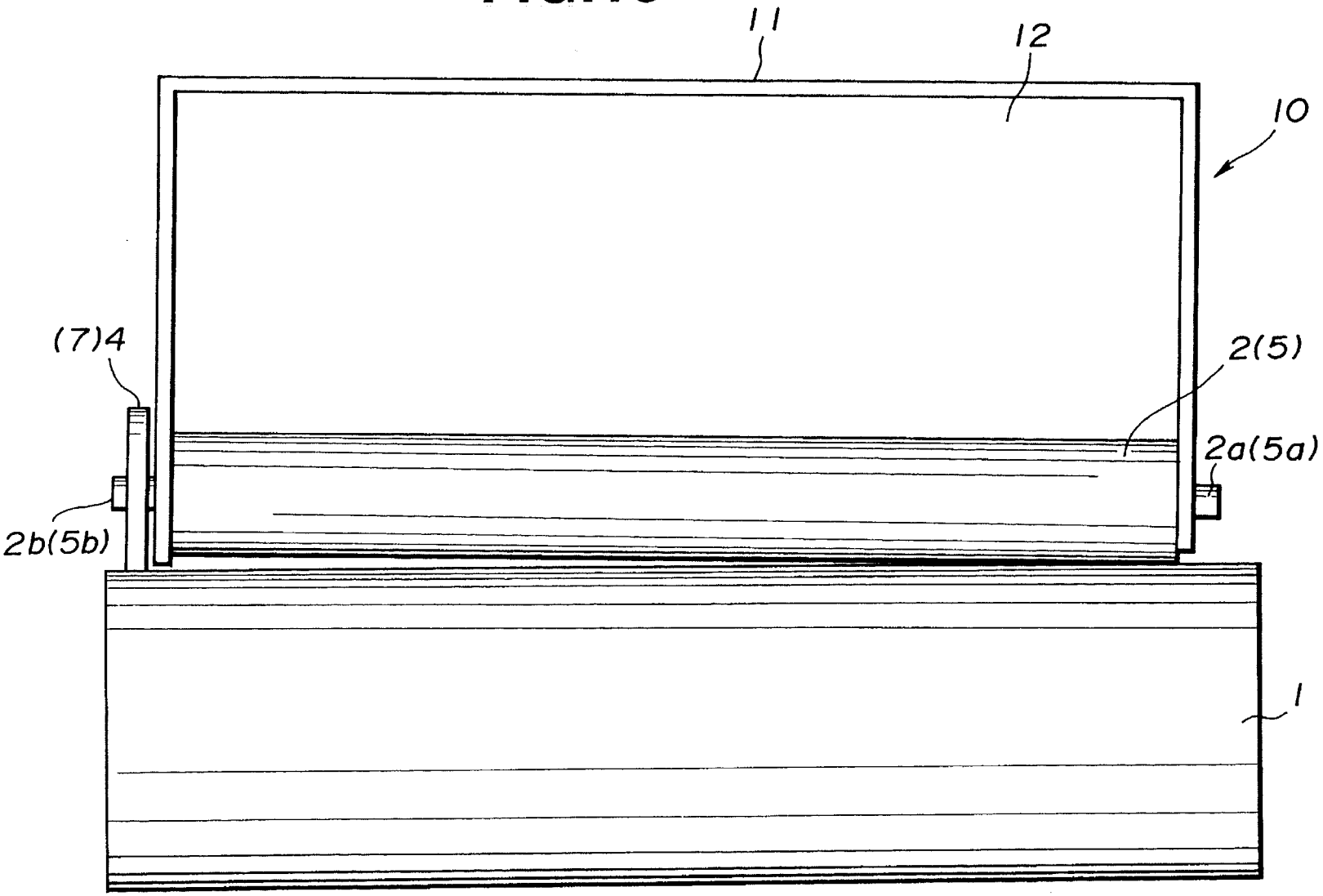
FIG. 13 is a diagram illustrating a state in which one end-portion of a developing roller contacts a photosensitive drum.

Developing unit 10 may in some cases be inserted into guide member 13 in an inclined state. In such a case, the axes of developing rollers 2 and 5 are geometrically skewed or twisted with respect to the axis of photosensitive drum 1. As a result, when pressing cam 15 is operated, an end-portion of each developing roller may contact photosensitive drum 1 at the side where the single spacer is provided, as shown in FIG. 13, thereby causing damage to photosensitive drum 1.

The reactive force produced when developing unit 10 is pressed against photosensitive drum 1 is applied by a greater amount on spacer roller 20 than on spacer rollers 4 and 7. Hence, shaft 19 is apt to be deformed, and abrasion of spacer roller 20 is accelerated. As a result, the state of FIG. 13 may arise.

The following embodiment of the present invention can overcome the above-described drawbacks.

Figure 9:
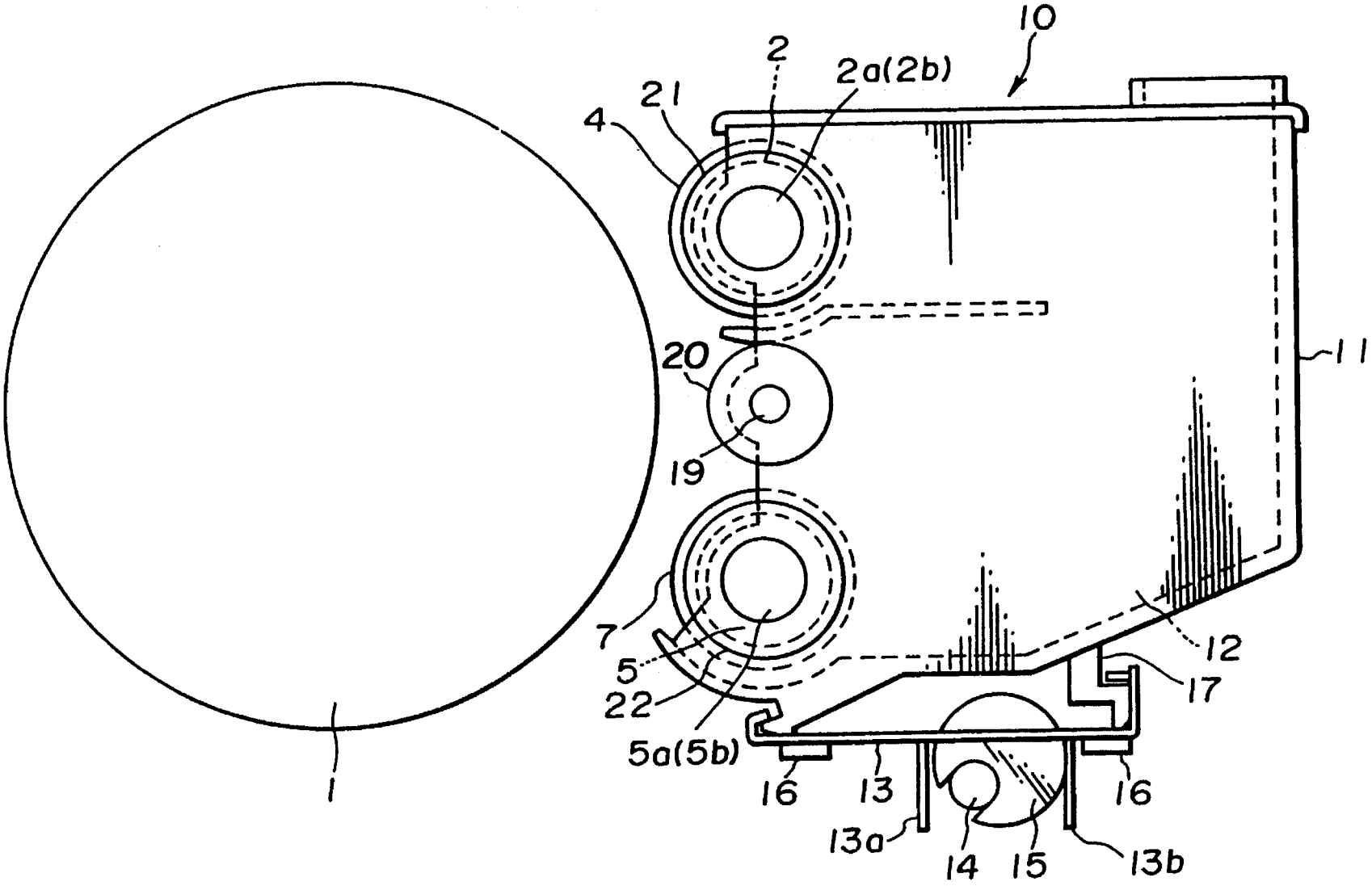
FIG. 9 is a side view illustrating a state of a principal portion of an apparatus according to still another embodiment of the present invention in which a developing unit is retracted from a photosensitive drum.
Figure 10:
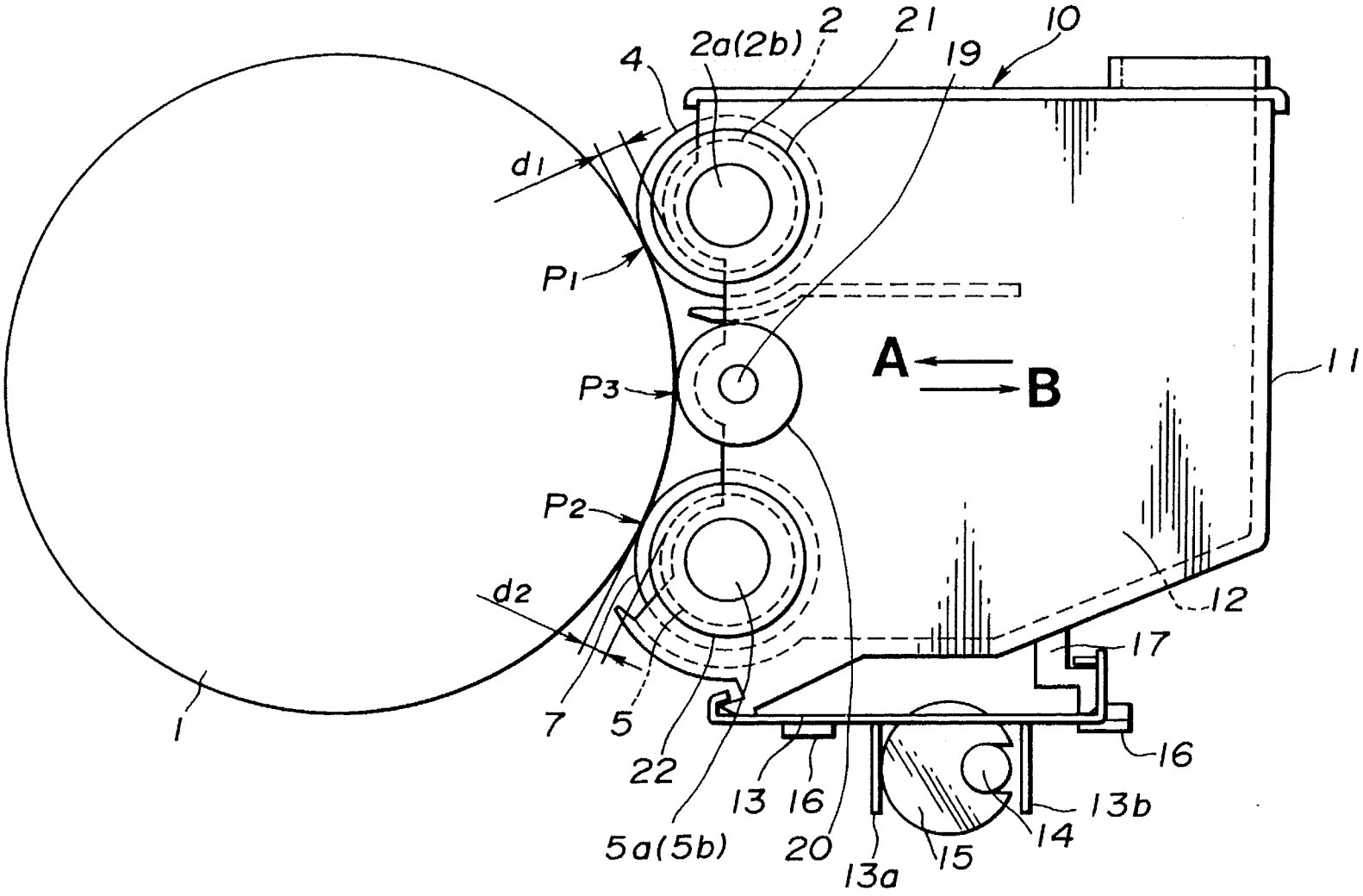
FIG. 10 is a side view illustrating a state of the principal portion of the apparatus shown in FIG. 9, in which the developing unit is advanced so that it is in pressure contact with the photosensitive drum.
Figure 11:
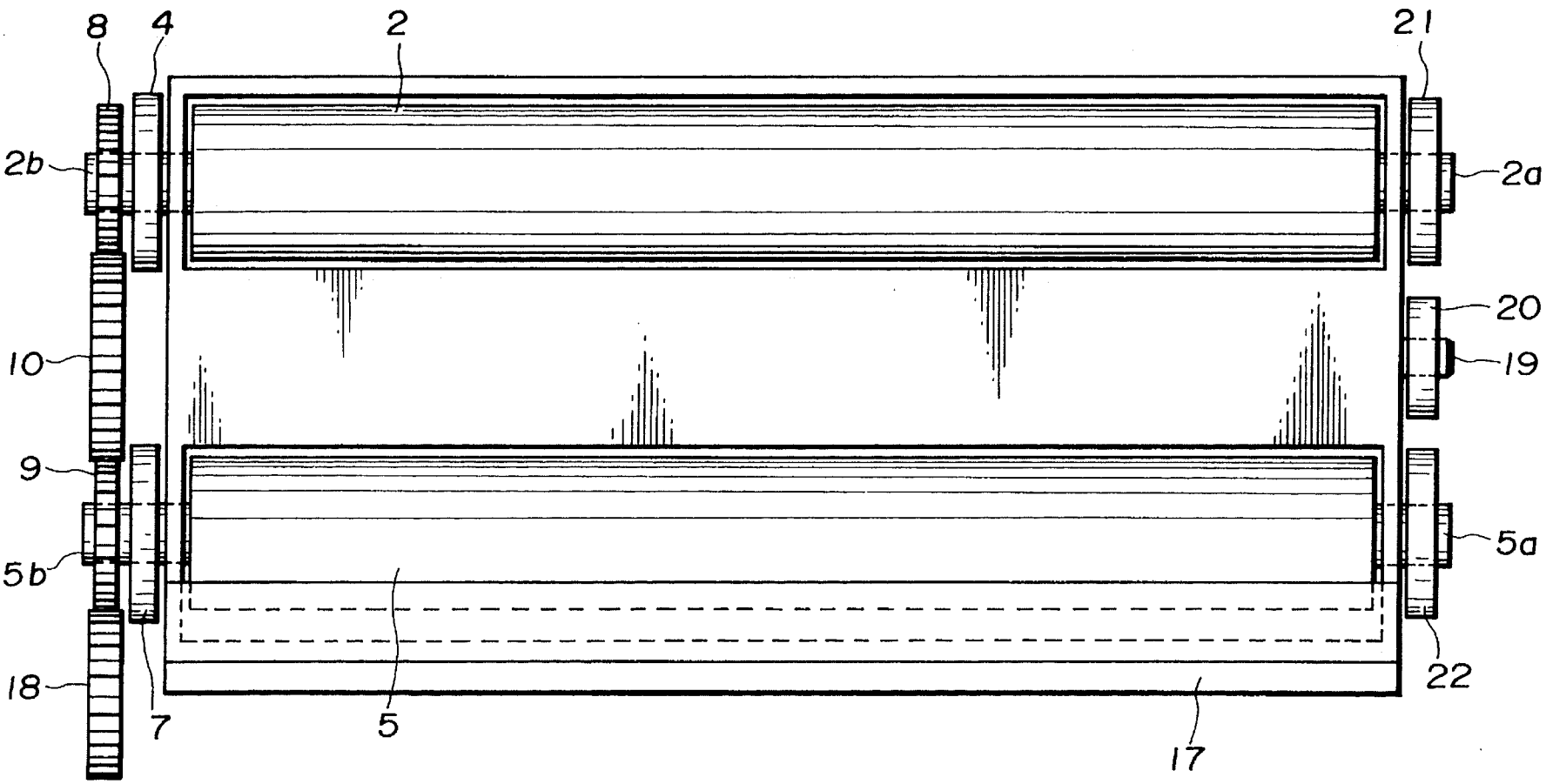
FIG. 11 is a front view of the developing unit shown in FIG. 9.
Figure 12:
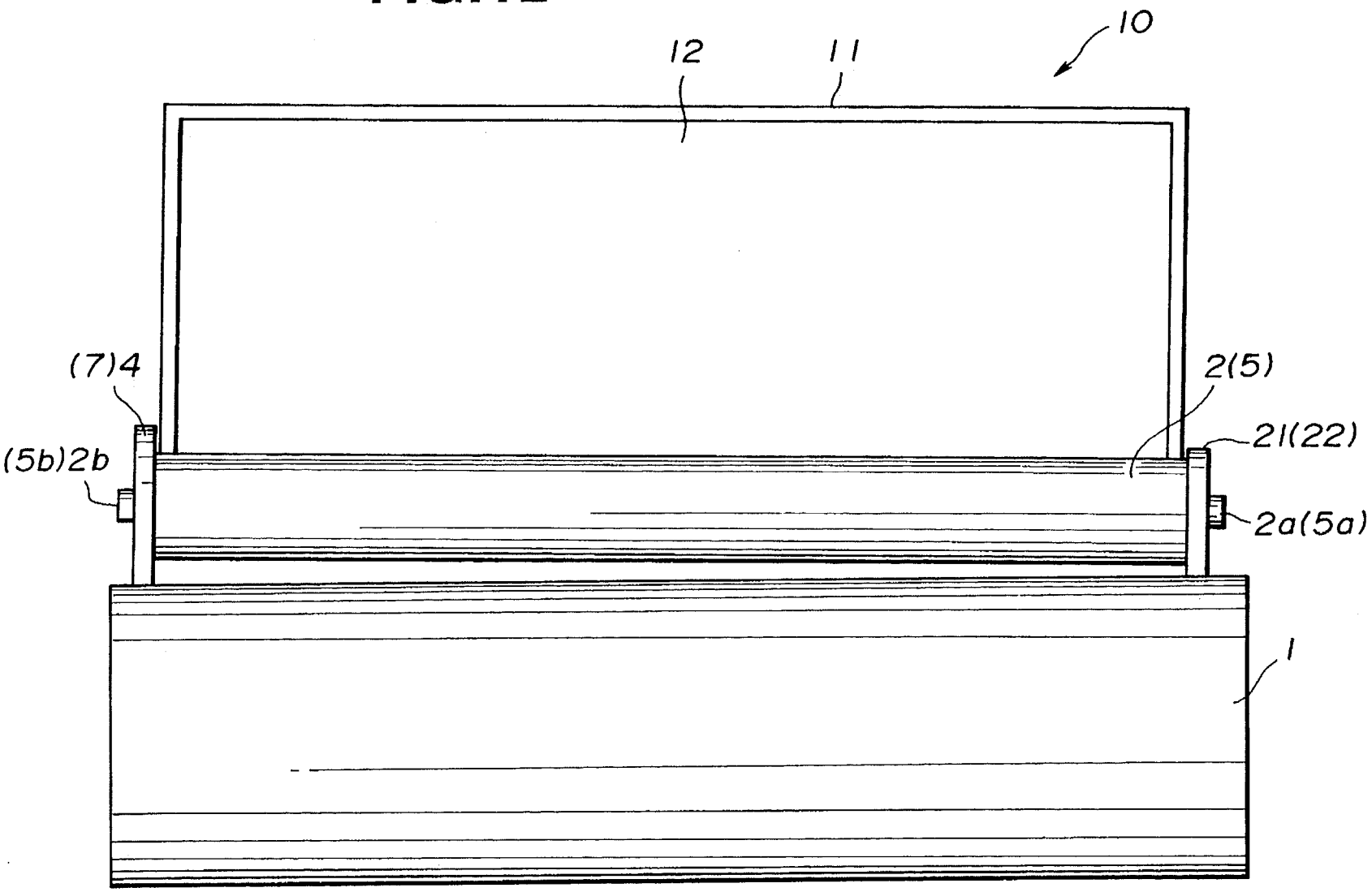
FIG. 12 is a diagram illustrating the function of an auxiliary roller of the apparatus shown in FIG. 9.

FIG. 9 illustrates a state in which developing unit 10 is in a non-operating position, and FIG. 10 illustrates a state in which developing unit 10 is in an operating position for development. FIG. 11 is a front view of developing unit 10, as seen from the side of the developing rollers.

The present embodiment differs from the embodiment shown in FIGS. 5 through 7 in that auxiliary rollers 21 and 22 are provided coaxially relative to first developing roller 2 and second developing roller 5, respectively, at the end-portion where the single spacer roller 20 is provided. That is, auxiliary rollers 21 and 22 are rotatably supported on shafts 2*a* and 5*a* fixed to first developing roller 2 and second developing roller 5, respectively.

The diameter of auxiliary roller 21 is greater than the diameter of developing roller 2, and is smaller than the diameter of spacer roller 4. The diameter of auxiliary roller 22 is greater than the diameter of developing roller 5, and is smaller than the diameter of spacer roller 7.

Accordingly, when developing unit 11 is inserted in guide member 13 in a correct configuration and spacer roller 20 is not worn, auxiliary rollers 21 and 22 do not contact photosensitive drum 1, as shown in FIG. 10, when developing unit 10 is advanced so that it is in pressure contact with photosensitive drum 1.

However, when developing unit 10 is mounted in guide member 13 in an inclined or skewed orientation, or when spacer roller 20 is abnormally worn, then when developing unit 10 is advanced so that it is in pressure contact with photosensitive drum 1, the above-described auxiliary rollers 21 and 22 contact photosensitive drum 1 at the side where the single spacer 20 is provided, thereby preventing direct contact of an end-portion of each developing roller to photosensitive drum 1 as shown in FIG. 13.

In the above-described embodiments, the relative positional relationship among the three spacers is fixed on the developing unit.

On the other hand, in the following embodiments of the present invention, four spacers in total are provided on the developing unit, and the relative positional relationship of two of the spacers with respect to the other two spacers is invariable. Thus, all four spacers securely contact the photosensitive drum.

An explanation will now be provided of still another embodiment of the present invention with reference to FIGS. 14 through 18. In this embodiment, developing unit 10, including two developing rollers in total, is configured by first developing-unit component 103 and second developing-unit component 104, which can relatively move.

Figure 14:
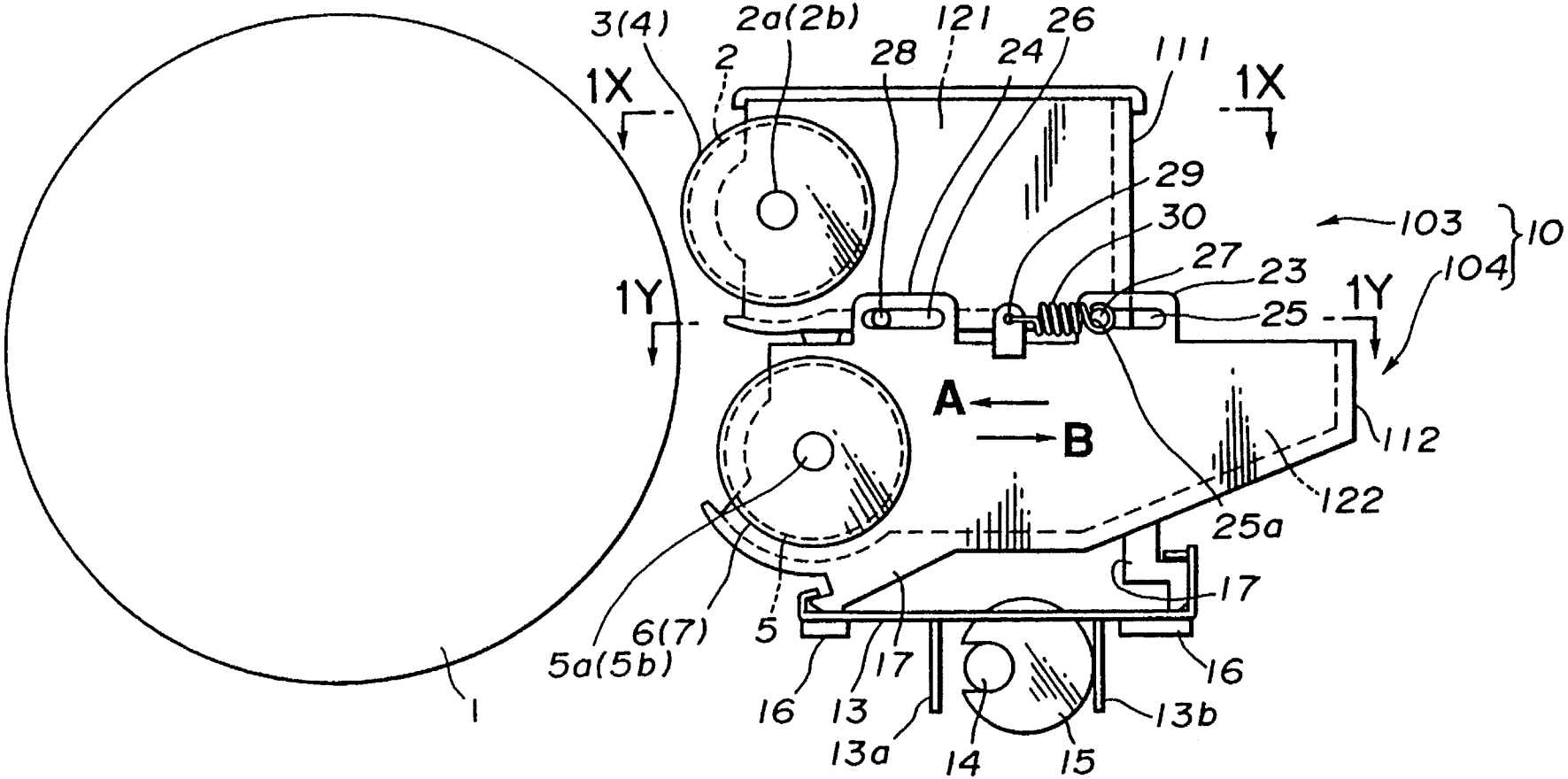
FIG. 14 is a side view illustrating a principal portion of an apparatus according to still another embodiment of the present invention, in which a developing unit is retracted from a photosensitive drum.

In FIG. 14, developing unit 10 is disposed in a retracted or non-operating position.

First developing-unit component 103 includes receptacle 111 incorporating a developer-accommodating chamber 121 for accommodating a one-component developer. First developing roller 2 having the same configuration as the above-described one is rotatably supported in this receptacle 111.

Figure 17:
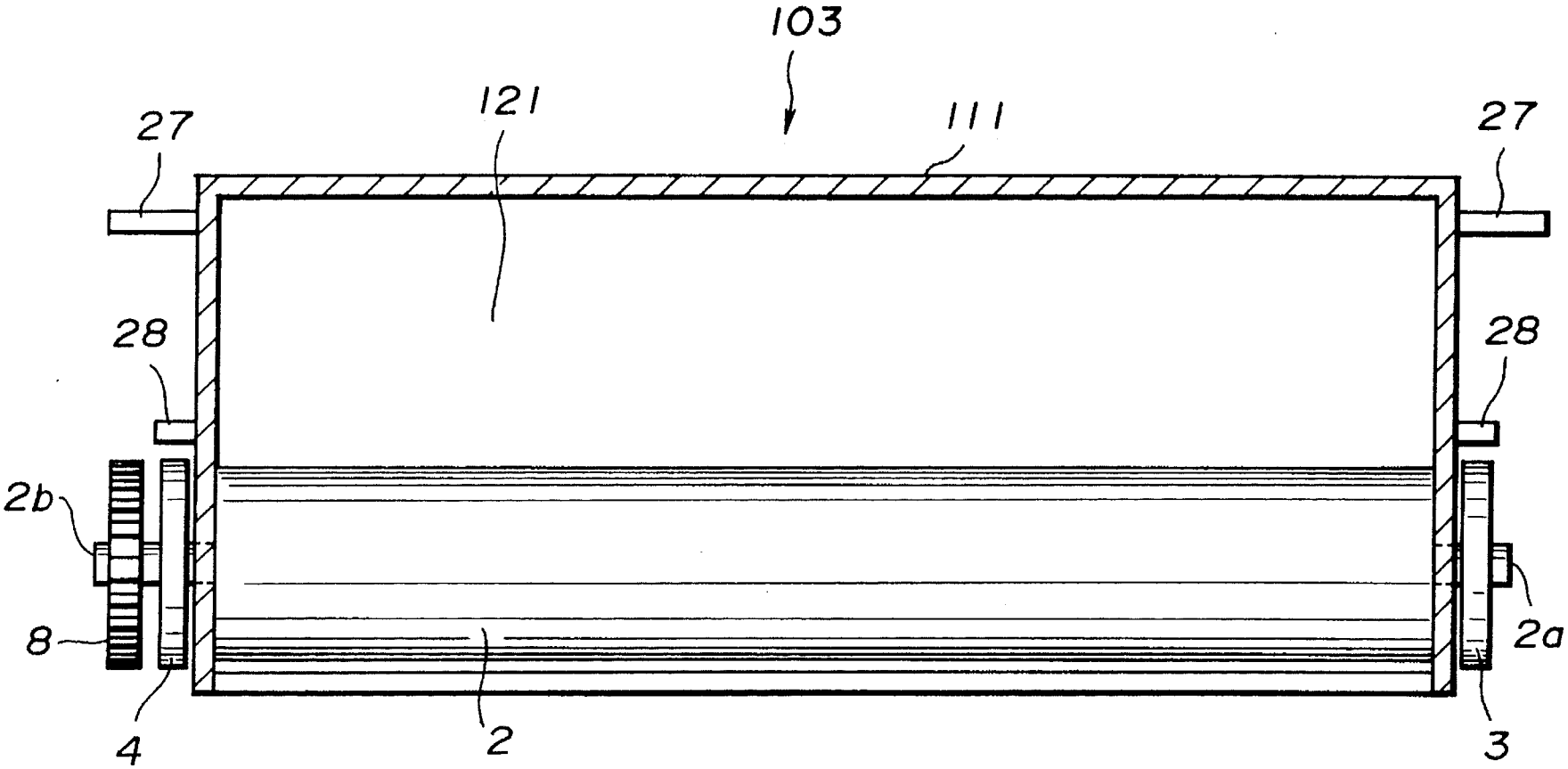
FIG. 17 is a diagram illustrating a first portion of the developing unit shown in FIG. 14, as seen in the direction 1X—1X shown in FIG. 14.

As shown in FIG. 17, which is a view as seen from line 1X—1X of FIG. 14, spacer rollers 3 and 4 are rotatably supported on shafts 2*a* and 2*b* fixed to two end-portions of first developing roller 2 in the longitudinal direction, respectively.

Gear 8, to which the rotational driving force is transmitted in the same manner as described above, is fixed to shaft 2*b*.

Second developing-unit component 104 includes receptacle 112 incorporating developer-accommodating chamber 122 for accommodating a one-component developer. Second developing roller 5 having the same configuration as the above-described one is rotatably supported in this receptacle 112.

Figure 18:
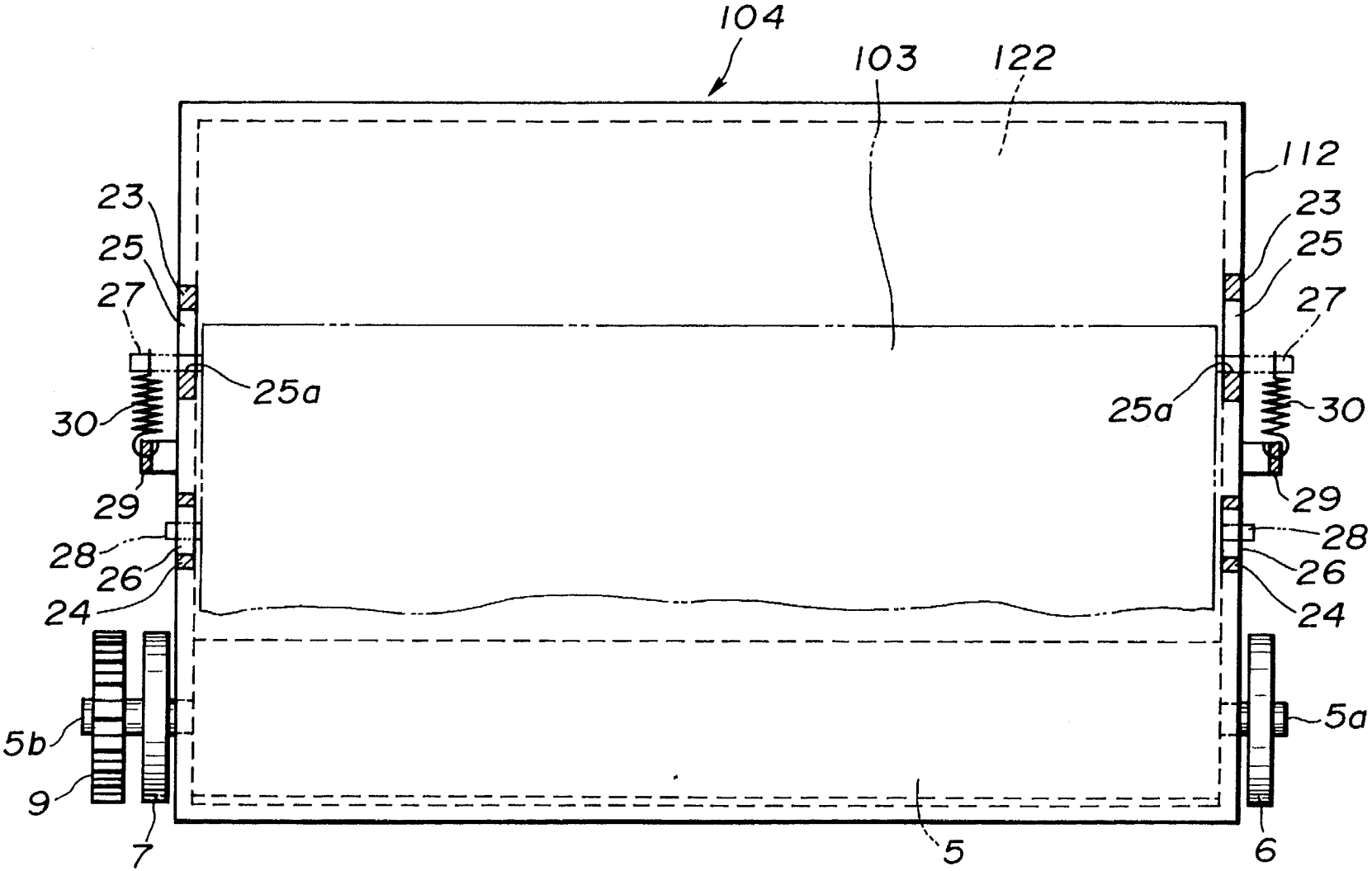
FIG. 18 is a diagram illustrating a second portion of the developing unit shown in FIG. 14, as seen in the direction 1Y—1Y shown in FIG. 14.

As shown in FIG. 18, which is a view as seen from line 1*y*—1*y* of FIG. 14, spacer rollers 6 and 7 are rotatably supported on shafts 5*a* and 5*b* fixed to two end-portions of second developing roller 5 in the longitudinal direction, respectively.

Gear 9, to which the rotational driving force is transmitted in the same manner as described above, is fixed to shaft 5*b*.

The one-component developer accommodated in each of accommodating chambers 121 and 122 has the same color. In other words, the developer has the same component. Accordingly, each of first developing rollers 2 and 5 supplies photosensitive drum 1 with developer having the same color.

The above-described first developing-unit component 103 is slidably mounted on second developing-unit component 104. That is, first developing-unit component 103 can be relatively moved with respect to second developing-unit component 104 in the directions of arrows A and B. As described above, developing unit 10 advances toward photosensitive drum 1 in the direction of arrow A, and developing unit 10 leaves photosensitive drum 1 in the direction of arrow B.

Foot member 17 having the above-described configuration is provided at second developing-unit component 104. By inserting this foot member 17 into guide member 13 having the above-described configuration, developing unit 10 may be mounted on the main body of the image forming apparatus.

Slots 25 and 28, which are long in the directions of arrows

A and B, are provided in receptacle 112 of second developing-unit component 104. Bars 27 and 28 fixed to receptacle 111 of first developing-unit component 103 are slidably inserted in the above-described slots 25 and 26, respectively. Thus, the relative movement of first developing-unit component 103 with respect to second developing-unit component 104 in the directions of arrows A and B is guided.

One end-portion of extension spring 30 is anchored at projection 29 of second developing-unit component 104, and another end-portion of the spring 30 is anchored at the bar 27 of first developing-unit component 103. Thus, first developing-unit component 103 is elastically driven in the direction of arrow A. As a result, second developing-unit component 104 is elastically driven by reaction in the direction of arrow B.

In the state of FIG. 14, bar 27 engages one end 25*a* of slot 25, as shown in FIG. 18. Thus, first developing-unit component 103 is restricted to relatively move with respect to second developing-unit component 104 in the direction of arrow A from the state of FIG. 14.

In the state of FIG. 14, when shaft 14 of the pressing means is rotated in a counterclockwise direction by a motor or by a manual operation of the operator in the above-described manner, cam 15 contacts pressure receiving member 13*a* of guide member 13 to push it in the direction of arrow A. Developing unit 10 thereby starts to move in the direction of arrow A as one body with guide member 13.

Figure 15:
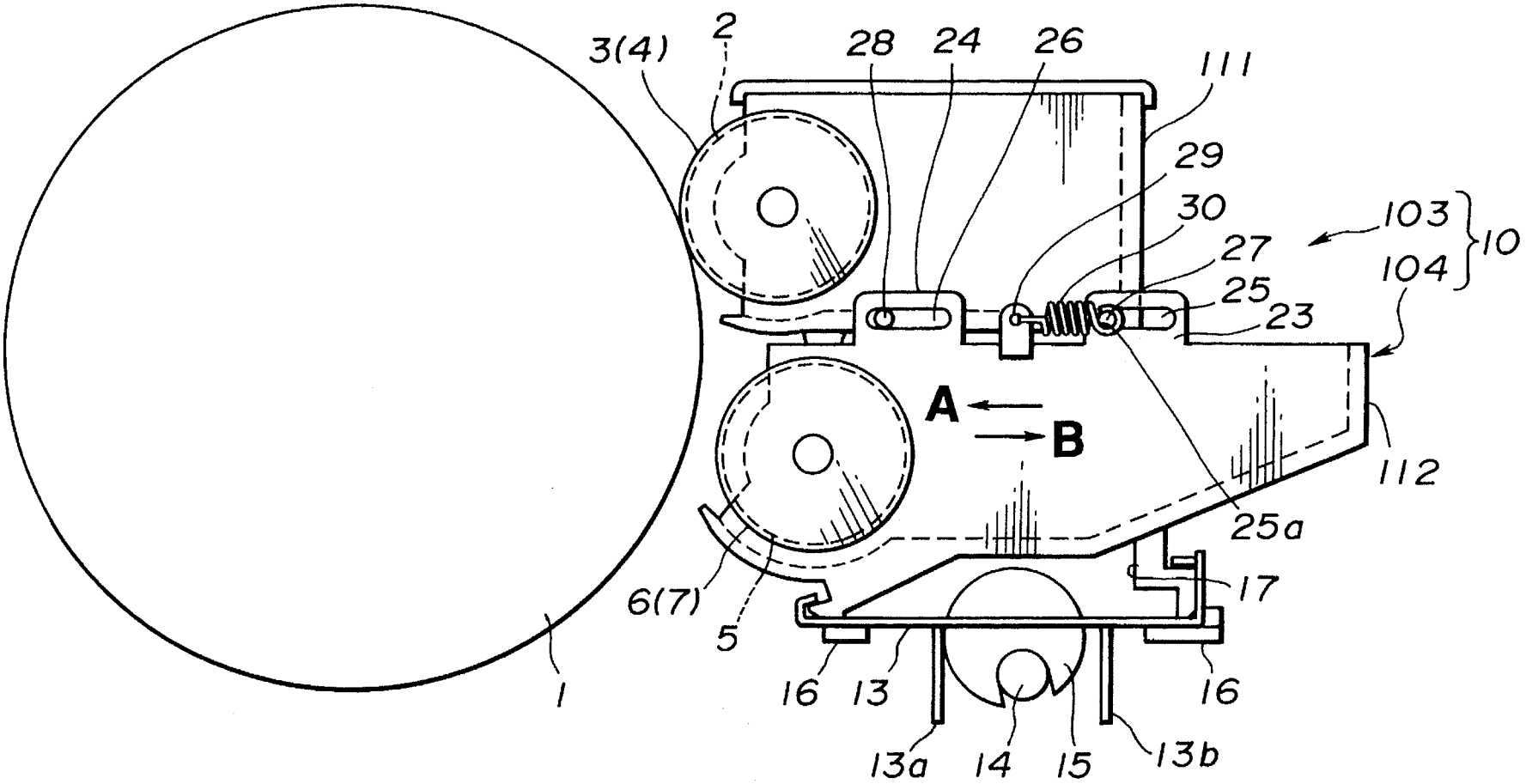
FIG. 15 is a side view illustrating a state of the principal portion of the apparatus shown in FIG. 14 in which the developing unit is in course of moving from a retracted position ton advanced position, or vice versa.

Thereafter, as shown in FIG. 15, first developing-unit component 103 first contacts photosensitive drum 1. That is, spacer rollers 3 and 4 provided coaxially with respect to first developing roller 2 first contact photosensitive drum 1. The movement of first developing-unit component 103 in the direction of arrow A is thereby stopped, and component 103 is positioned at the operating position for development. At that time, the above-described driven gear 8 provided at an end portion of roller 2 meshes with a driving-force transmission gear (not shown) which is coaxially provided at one end-portion of photosensitive drum 1.

When cam 15 further rotates in a counterclockwise direction, second developing-unit component 104 is further pressed in the direction of arrow A, whereby second developing-unit component 104 further moves in the direction of arrow A. At that time, since the movement of first developing-unit component 103 has already been stopped, second developing-unit component 104 relatively moves with respect to first developing-unit component 103 in the direction of arrow A. Accordingly, bars 27 and 28 provided at first developing-unit component 103 relatively move with respect to second developing-unit component 104 in the direction of arrow B by being guided in slots 25 and 26, respectively. Spring 30 is thereby more or less extended, producing an elastic force, which contributes to increase the pressing force of first developing-unit component 103 against photosensitive drum 1.

Figure 16:
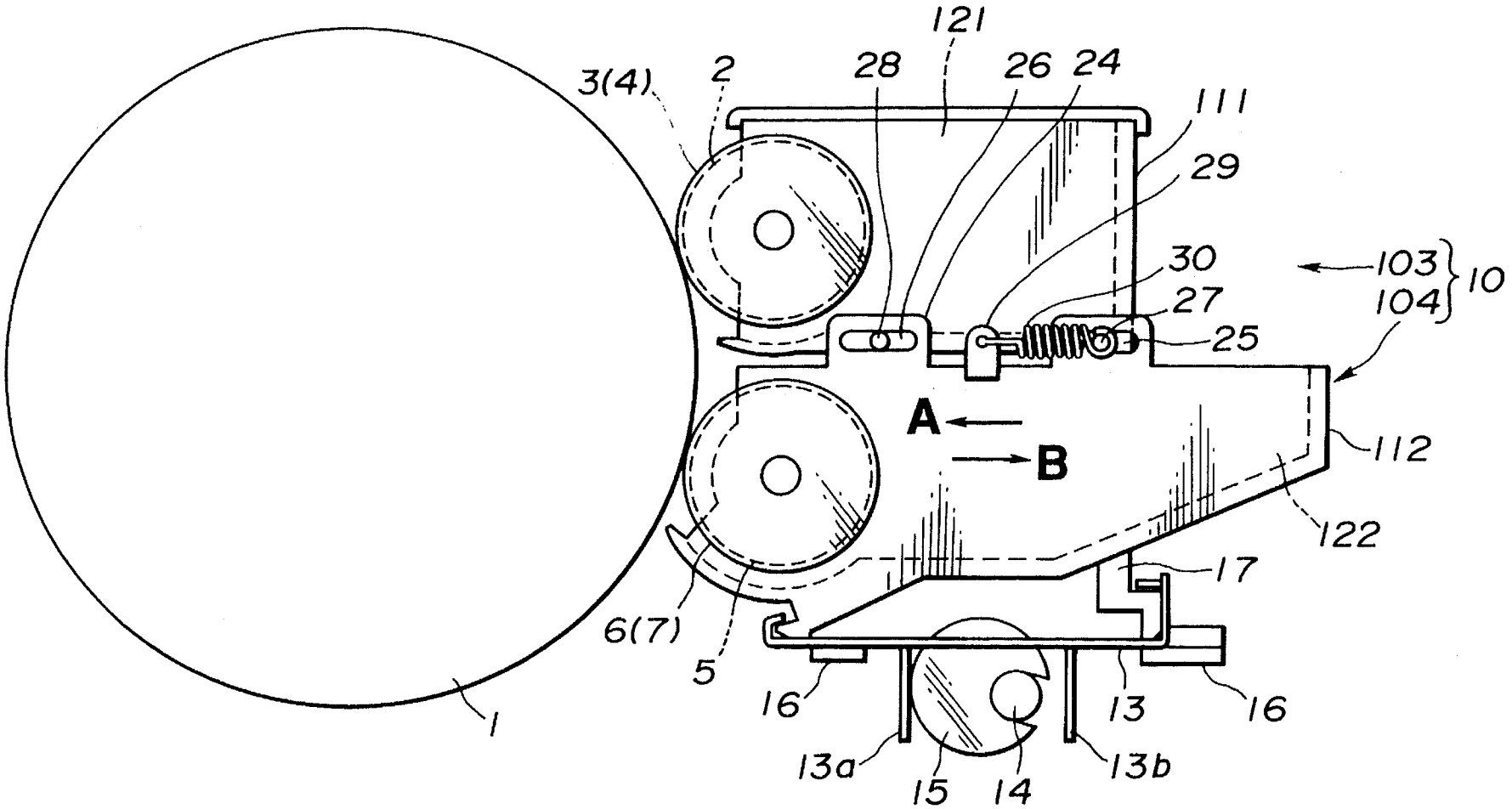
FIG. 16 is a side view illustrating a state of the principal portion of the apparatus shown in FIG. 14, in which the developing unit is advanced so that it pressure contacts the photosensitive drum.

When cam 15 further rotates in a counterclockwise direction, second developing-unit component 104 finally contacts photosensitive drum 1, as shown in FIG. 16. That is, spacer rollers 6 and 7 provided coaxially with respect to second developing roller 5 contact photosensitive drum 1, and second developing-unit component 104 is also positioned at the operating position for development. At that time, the above-described driven gear 9 meshes with the above-described driving-force transmission gear.

In the state of FIG. 16, when an image forming operation is performed and photosensitive drum 1 rotates in a clockwise direction, first and second developing rollers 2 and 5 rotate in a counterclockwise direction in synchronization with the rotation of photosensitive drum 1, to carry the developer from developer accommodating chambers 121 and 122 and to supply the developer to photosensitive drum 1. At that time, the above-described developing bias voltage is applied to rollers 2 and 5.

When, for example, detaching developing unit 10 or photosensitive drum 1 from the main body of the image forming apparatus, shaft 14 is rotated in a clockwise direction by a motor or a manual operation of the operator. Cam 15 thereby contacts pressure receiving member 13*b* of guide member 13, to start to move guide member 13 in the direction of arrow B.

Thus, as shown in FIG. 15, second developing-unit component 104 first leaves photosensitive drum 1. At that time, first developing-unit component 103 remains in pressure contact with photosensitive drum 1 by the driving force of spring 30. Accordingly, second developing-unit component 104 relatively moves with respect to first developing-unit component 103 in the direction of arrow B. In other words, bars 27 and 28 provided at first developing-unit component 103 relatively move along slots 25 and 26 provided in second developing-unit component 104 in the direction of arrow A.

When cam 15 further rotates, end portion 25*a* of slot 25 contacts bar 27. Upon further rotation of cam 15 from that time, first developing-unit component 103 and second developing-unit component 104 are moved as one body in the direction of arrow B, until they return to the non-operating position of FIG. 14. In a state in which both first developing-unit component 103 and second developing-unit component 104 are separated from photosensitive drum 1, bar 27 is disposed in pressure contact with one end 25*a* of slot 25 by the elastic force of spring 30. Hence, first developing-unit component 103 and second developing-unit component 104 do not perform relative movement, but move as one body.

In any case, it is necessary to engage second developing-unit component 104, which is pressed against photosensitive drum 1 later than first developing-unit component 103, with pressing means (13, 14 and 15).

Figure 19:
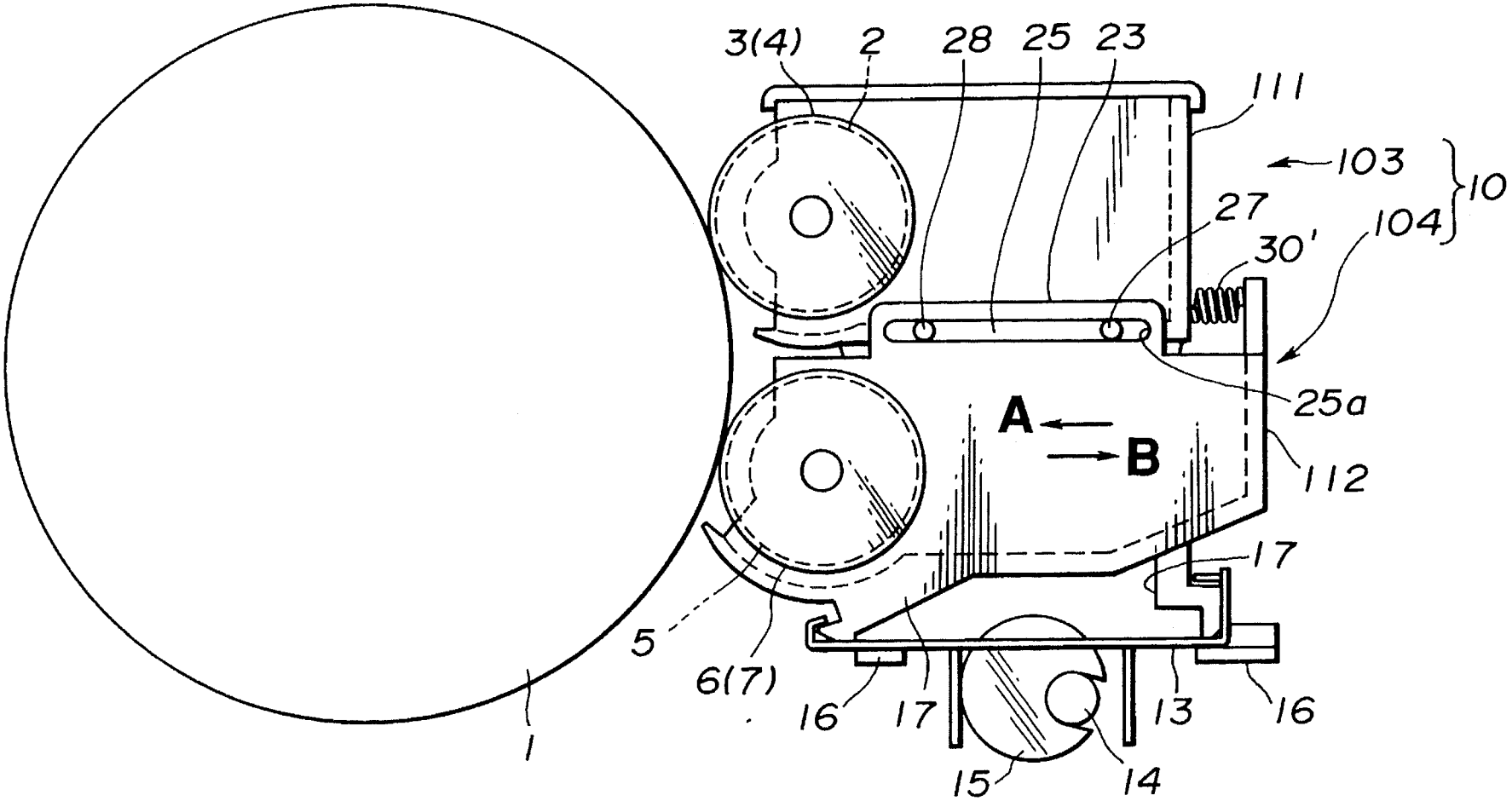
FIG. 19 is a side view illustrating a principal portion of an apparatus according to still another embodiment of the present invention.

An apparatus according to still another embodiment of the present invention shown in FIG. 19 is the same as the apparatus shown in FIGS. 14 through 18, except that two bars 28 and 27 of first developing-unit component 103 are inserted in a single slot 25 provided in second developing-unit component 104, and a compression spring 30' is provided between receptacles 111 and 112.

FIG. 19 illustrates a state in which developing unit 10 is in pressure contact with photosensitive drum 1. In a state in which developing unit 10 is retracted from photosensitive drum 1, bar 27 is disposed in pressure contact with the right end of slot 25 by the elastic force of spring 30', to regulate relative movement of first developing-unit component 103 with respect to second developing-unit component 104 in the direction of arrow A. In the present embodiment, slots 25 and 26 for guides mat be provided in first developing-unit component 103, and bars 27 and 28 for connection may be provided in second developing-unit component 104.

In the above-described embodiments shown in FIGS. 14 through 18 and in FIG. 19, developing unit 10 has four spacers in total corresponding to two developing rollers, and first developing-unit component 103 and second developing-unit component 104 are provided so as to be relatively movable. First developing-unit component 103 is advanced so as to be in pressure contact with photosensitive drum 1 first, and second developing-unit component 104 is then further advanced so as to be in pressure contact with photosensitive drum 1. Hence, the two spacer rollers 3 and 4 provided at first developing-unit component 103 at two end-portions of the developing rollers in the longitudinal direction, and the two spacer rollers 6 and 7 provided at second developing-unit component 104 at two end-portions of the developing rollers in the longitudinal direction are securely disposed in pressure contact with photosensitive drum 1. That is, the four spacer rollers are securely maintained in pressure contact with photosensitive drum 1 during operation.

Although in the above-described embodiments, a description has been provided of developing units, each using a one-component developer, the present invention may also be applied to an apparatus which uses a two-component developer. The present invention may also be applied to an apparatus of a so-called contact-development type, in which a developer carried by a developer bearing member is provided in contact with an image bearing member to develop an electrostatic latent image. Furthermore, the present invention may be applied not only to a copier, but also may be applied to a printer in which an electrophotographic photosensitive member is exposed by a light source driven in response to an image signal representing an image to be recorded.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus, comprising:

an image bearing member;

a developing unit for developing an electrostatic latent image formed on said image bearing member;

supporting means for supporting said developing unit for movement relative to said image bearing member between a contact position and a non-contact position; and pressing means for advancing and retracting said developing unit between the contact position and the non-contact position, and for pressing said developing unit against said image bearing member in the contact position;

said developing unit comprising:

first and second developer bearing members facing said image bearing member for carrying a developer and for supplying the developer to said image bearing member;

holding means for holding said first and second developer bearing members and for aligning said first and second developer bearing members in a moving direction of said image bearing member; and first and second spacers disposed at one end portion of said developing unit in a longitudinal direction of said developer bearing members with an interval spacing in a moving direction of said image bearing member, and a third spacer disposed at the other end portion of said developing unit in the longitudinal direction of said developer bearing members, said first, second and third spacers being arranged for contacting said image bearing member in the contact position with a pressing force of said pressing means, thereby to form a first gap between said first developer bearing member and said image bearing member, and a second gap between said second developer bearing member and said image bearing member.

2. An apparatus according to claim 1, wherein each of said first and second developer bearing members comprises a rotatable developing roller, wherein each of said first and second spacers comprises a spacer roller provided coaxially with a respective one of said first and second developer bearing members, and wherein said third spacer comprises a spacer roller mounted on said holding means.

3. An apparatus according to claim 2, wherein an axis of rotation of said third spacer is positioned between an axis of rotation of said first developer bearing member and an axis of rotation of said second developer bearing member in the moving direction of said image bearing member.

4. An apparatus according to claim 3, further comprising driving means, and first and second gears for receiving a rotational driving force from said driving means, said first and second gears being fixed to respective end portions of said first and second developer bearing member.

5. An apparatus according to claim 2, further comprising driving means, and first and second gears for receiving a rotational driving force from said driving means, said first and second gears being fixed to respective end portions of said first and second developer bearing members.

6. An apparatus according to claim 1, wherein each of said first, second and third spacers comprises a projection provided at said holding means.

7. An apparatus according to claim 6, further comprising driving means, and first and second gears for receiving a rotational force from said driving means, said first and second gears being fixed to respective end portions of said first and second developer bearing members.

8. An apparatus according to claim 1, further comprising driving means, and first and second gears for receiving a rotational driving force from said driving means, said first and second gears being fixed to respective end portions of said first and second developer bearing members.

9. An apparatus according to claim 1, further comprising first and second auxiliary rollers provided coaxially on respective end portions of said first and second developer bearing members, respectively, for preventing said first and second developer bearing members from contacting said image bearing member.

10. An image forming apparatus, comprising:

an image bearing member;

a developing unit for developing an electrostatic latent image formed on said image bearing member, said developing unit including:

a first developing unit component including a first developer bearing member for carrying a developer and for supplying the developer to said image bearing member, and first and second spacers provided at respective end portions of said first developing unit component in a longitudinal direction of said first developer bearing member and arranged for pressure contacting said image bearing member, and a second developing unit component including a second developer bearing member for carrying the developer and for supplying the developer to said image bearing member, and third and fourth spacers provided at respective end portions of said second developing unit component in the longitudinal direction of said second developer bearing member and arranged for pressure contacting said image bearing member, said first and second developing unit components being mechanically coupled for relative movement therebetween;

supporting means for supporting said developing unit for movement relative to said image bearing member between a contact position and a non-contact position; and pressing means for advancing and retracting said developing unit between the contact position and the non-contact position, and for applying a pressing force to said second developing unit component thereby to press said developing unit against said image bearing member, wherein, when said developing unit is advanced to the contact position by said pressing means, said first and second spacers of said first developing unit component are first pressure contacted to said image bearing member, and said third and fourth spacers of said second developing unit component are then pressure contacted to said image bearing member.

11. An apparatus according to claim 10, wherein said developing unit further comprises elasticity applying means, engaging said first developing unit component and said second developing unit component, for applying an elastic force to said first developing unit component in an advancing direction of said developing unit, and for applying an elastic force to said second developing unit component in a retracting direction of said developing unit.

12. An apparatus according to claim 11, wherein each of said first and second developer bearing members comprises a rotatable developing roller, wherein each of said first and second spacers comprises a spacer roller provided coaxially with respect to said first developer bearing member, and wherein each of said third and fourth spacers comprises a spacer roller provided coaxially with respect to said second developer bearing member.

13. An apparatus according to claim 12, wherein each of said first developing unit component and said second developing unit component supplies said image bearing member with a developer having the same color.

14. An apparatus according to claim 12, wherein said supporting means is movable, wherein said second developing unit component of said developing unit is held by said supporting means, and wherein said pressing means engages said supporting means.

15. An apparatus according to claim 11, wherein each of said first developing unit component and said second developing unit component supplies said image bearing member with a developer having the same color.

16. An apparatus according to claim 11, wherein said supporting means is movable, wherein said second developing unit component of said developing unit is held by said supporting means, and wherein said pressing means engages said supporting means.

17. An apparatus according to claims 10, wherein each of said first developing unit component and said second developing unit component supplies said image bearing member with a developer having the same color.

18. An apparatus according to claim 17, wherein said supporting means is movable, wherein said second developing unit component of said developing unit is held by said supporting means, and wherein said pressing means engages said supporting means.

19. An apparatus according to claim 10, wherein said supporting means is movable, wherein said second developing unit component of said developing unit is held by said supporting means, and wherein said pressing means engages said supporting means.

* * * * *

UNITED STATES PATENT AND TRADEMARK OFFICE

CERTIFICATE OF CORRECTION

PATENT NO. : 5,471,286

DATED : November 28, 1995

INVENTOR(S) : MAKOTO TANAKA

It is certified that error appears in the above-indentified patent and that said Letters Patent is hereby corrected as shown below:

Column 1

Line 10, "elestro-" should read --electro- --.

Column 3

Line 34, "baring" should read --bearing--.

Column 5

Line 32, "ton" should read --to an--.

Column 7

Line 55, "gap" should read --gap $d_1$--.

Column 10

Line 40, "1y-1y" should read --1Y-1Y--.
Line 67, "28," should read --26,--.

UNITED STATES PATENT AND TRADEMARK OFFICE

CERTIFICATE OF CORRECTION

PATENT NO. : 5,471,286

DATED : November 28, 1995

INVENTOR(S) : MAKOTO TANAKA

It is certified that error appears in the above-indentified patent and that said Letters Patent is hereby corrected as shown below:

Column 12

Line 57, "mat" should read --may--.

Column 16

Line 21, "claims 10," should read --claim 10,--.

Signed and Sealed this

Thirtieth Day of April, 1996

Bruce Lehman

*Attest:*

BRUCE LEHMAN

*Attesting Officer*

*Commissioner of Patents and Trademarks*